US006785488B2

(12) United States Patent
Katsuyama

(10) Patent No.: US 6,785,488 B2
(45) Date of Patent: Aug. 31, 2004

(54) IMAGE FORMATION METHOD, IMAGE FORMATION APPARATUS, COMPUTER PROGRAM, AND STORAGE MEDIUM

(75) Inventor: Goro Katsuyama, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/359,680

(22) Filed: Feb. 7, 2003

(65) Prior Publication Data

US 2003/0170041 A1 Sep. 11, 2003

(30) Foreign Application Priority Data

Feb. 8, 2002 (JP) ..... 2002-032503

(51) Int. Cl.[7] ..... G03G 15/00

(52) U.S. Cl. ..... 399/84; 358/526; 382/181; 399/16; 399/45; 399/82; 399/374

(58) Field of Search ..... 399/84, 82, 16, 399/17, 374, 381, 194, 306, 45; 358/526, 530, 540, 443, 450, 496; 382/181, 182, 183, 317

(56) References Cited

U.S. PATENT DOCUMENTS 4,958,187 A * 9/1990 Tsuchiya et al. ..... 399/306
5,946,527 A * 8/1999 Salgado et al. ..... 399/82
6,304,739 B1 10/2001 Katsuyama et al. ..... 399/262
6,507,720 B2 1/2003 Kabumoto et al. ..... 399/258
6,519,436 B2 2/2003 Katsuyama ..... 399/258
6,532,352 B2 3/2003 Katsuyama ..... 399/262
6,549,744 B2 4/2003 Terazawa et al. ..... 399/262
2002/0106209 A1 * 8/2002 Niimura et al. ..... 399/45

FOREIGN PATENT DOCUMENTS

JP 04-146458 * 5/1992
JP 08-305094 * 11/1996
JP 11-187247 7/1999

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image read from a document is analyzed to check whether the image includes a guide information at a predetermined position of the image. The guide information represents, for example, a layout of the document on the paper. The direction of a paper on which the image read is to be formed on a paper is adjusted based on the guide information included in the image. Thus, an operator is not required to adjust the direction of the paper. The guide information may include information such as whether the image is to be formed on both sides of the paper.

33 Claims, 24 Drawing Sheets

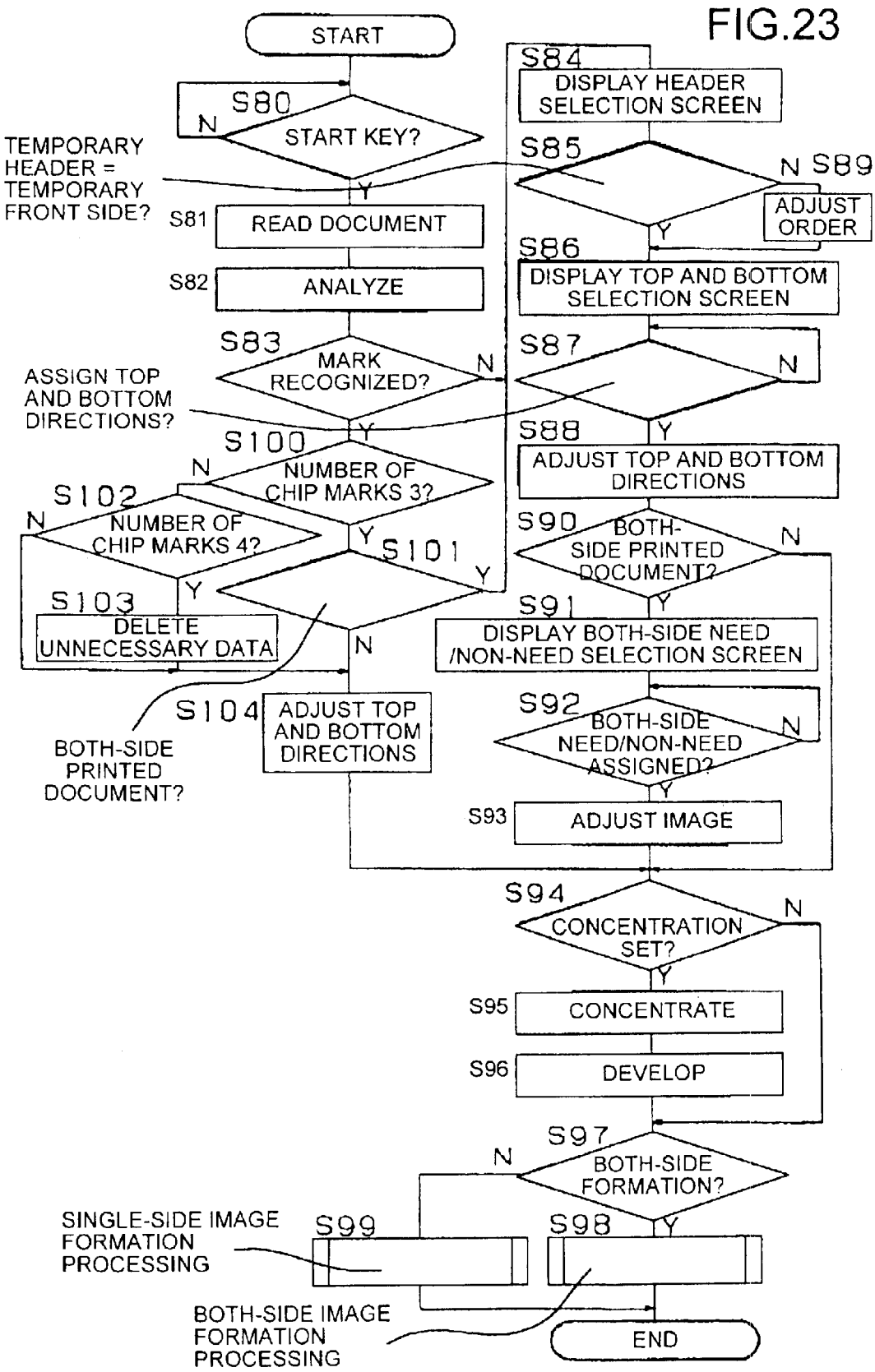
FIG.23
START
S80
START KEY?
N
Y
TEMPORARY HEADER = TEMPORARY FRONT SIDE?
S81
READ DOCUMENT
S82
ANALYZE
S83
MARK RECOGNIZED?
ASSIGN TOP AND BOTTOM DIRECTIONS?
S100
NUMBER OF CHIP MARKS 3?
S102
NUMBER OF CHIP MARKS 4?
S101
S103
DELETE UNNECESSARY DATA
S104
ADJUST TOP AND BOTTOM DIRECTIONS
BOTH-SIDE PRINTED DOCUMENT?
S84
DISPLAY HEADER SELECTION SCREEN
S85
S89
ADJUST ORDER
S86
DISPLAY TOP AND BOTTOM SELECTION SCREEN
S87
S88
ADJUST TOP AND BOTTOM DIRECTIONS
S90
BOTH-SIDE PRINTED DOCUMENT?
S91
DISPLAY BOTH-SIDE NEED /NON-NEED SELECTION SCREEN
S92
BOTH-SIDE NEED/NON-NEED ASSIGNED?
S93
ADJUST IMAGE
S94
CONCENTRATION SET?
S95
CONCENTRATE
S96
DEVELOP
S97
BOTH-SIDE FORMATION?
SINGLE-SIDE IMAGE FORMATION PROCESSING
S99
S98
BOTH-SIDE IMAGE FORMATION PROCESSING
END

IMAGE FORMATION METHOD, IMAGE FORMATION APPARATUS, COMPUTER PROGRAM, AND STORAGE MEDIUM

BACKGROUND OF THE INVENTION

1) Field of the Invention

The present invention relates to an image formation method, an image formation apparatus, a computer program, and a storage medium.

2) Description of the Related Art

Conventionally, there has been a digital copying machine comprising an image reading apparatus that sequentially reads images from a set plurality of sheets of documents, and an image formation apparatus that sequentially forms the images read by the image reading apparatus onto sheets of copying paper in the order that the images are read.

Some digital copying machines comprise an image reading apparatus that can read images from both sides of a document. Such digital copying machines can read the image from one side of the document or the images from both sides of the document, by changing over the reading mode of the image reading apparatus between a single-side reading mode of reading the image from one side of the document and a both-side reading mode of reading the images from both sides of the document. An operator sets a reading mode according to a type of document such as a single-side printed document that has a necessary image formed on one side of the document and a both-side printed document that has necessary images formed on both sides of the document. Based on this setting, the image reading apparatus can read the document in the reading mode suitable for the type of the document.

The above-described image reading apparatus in the digital copying machine generally has a structure of setting a document such that the image side of a single-side printed document (hereinafter referred to as "front side") passes through the reading position the image reading apparatus. Under the setting of the single-side reading mode, the image reading apparatus reads only the image from the front side. Under the setting of the both-side reading mode, the image reading apparatus processes the image different from the image on the front side of the single-side reading mode, as the image on the back side of the document from among the images read from both sides of the document.

Further, some digital copying machines have an image formation apparatus that can form images on both sides of a sheet of paper. Such a digital copying machine can form the image on only one side of the paper or form images on both sides of the paper, by changing over the image formation mode between a single-side image formation mode of forming the image on one side of the paper and a two-side image formation mode of forming the images on both sides of the paper.

Further, under the setting of the single-side image formation mode, some digital copying machines enable the operator to optionally select between the formation of images on both blank sides of paper and the formation of the image on a blank side (a back side) of the paper with an unnecessary image formed on the other side. Such a digital copying machine makes it possible to effectively utilize the back side of the paper, by only setting the paper to match the purpose of using the paper after forming the image.

Further, some digital copying machines can set a concentration image formation mode of forming a plurality of images on one side of a sheet of paper. In order to set the concentration image formation mode, this digital copying machine requires the setting of a number of images to be concentrated. The number of images to be concentrated is an integer given by two to the n-th power (where n is an integer). The digital copying machine adjusts a size and a direction of a read image according to the number of images to be concentrated set under the concentration image formation mode, and forms a plurality of images in concentration within one side of the paper.

In order to form images under the setting of the concentration image formation mode, the image formation apparatus in the digital copying machine rotates the direction of the images to be concentrated, based on the set direction of the document images and the set number of images to be concentrated. For example, in order to concentrate images of A4-size documents onto an A4-size sheet of paper based on the number of images to be concentrated "two", the long side of the formed images is arranged parallel to the short side of the copying paper (refer to FIG. 28A). On the other hand, in order to concentrate images of A4-size documents onto an A4-size sheet of paper based on the number of images to be concentrated "four", the long side of the formed images is arranged parallel to the long side of the copying paper (refer to FIG. 28B). When the direction of the images to be formed in concentration is rotated according to the number of images to be concentrated, the images on vertically long document sheets may be formed onto a laterally long sheet of copying paper.

Some digital copying machines have a stapler that staples in bundle a plurality of sheets of paper on which images are formed by the image formation apparatus. This digital copying machine can staple the image-formed sheets based on the setting of a staple position, either at the upper side or at the side of the sheets. Because of weight and strength constraints, the stapler is not structured to be able to staple at any desired position of the image-formed sheets of paper. Instead, the stapler can staple the image-formed sheets of paper at a limited position. For example, some staplers can staple the image-formed sheets of paper at one side of the paper.

The conventional digital copying machine requires the operator to set the reading mode of the image reading apparatus and the image formation mode according to the documents to be read and the purpose of using the image-formed paper, the setting work is troublesome.

Further, according to the conventional digital copying machine, the image reading apparatus reads a preset one side of the document as the front side of the document, under the setting of the single-side reading mode. Therefore, when the front side and the back side of the document are set wrong by error in the single-side reading mode, the image reading apparatus reads the image from the back side as the image from the front side. As the unintended image of the back side is formed on the copying paper, this results in the wasting of the paper.

When the set top and bottom directions of a plurality of documents are out of order, the image reading apparatus of the conventional digital copying machine requires the rearrangement of the whole documents so that the top and bottom directions are in order.

Further, in the both-side reading mode, the image reading apparatus of the conventional digital copying machine processes the image different from the image of the front side in the single-side reading mode, as the image of the back side of the document out of the images read from both sides of the document. Therefore, when the front side and back side of the document are set wrong by error in the both-side reading mode, the images on the front side and the back side of the document are formed on wrong sides of the copying paper respectively.

When the image is formed under the setting of the mode of using the back side of image-formed paper, the operator may misunderstand that the image previously formed on one side of the paper is the image formed this time. This confusion is further expanded when the image (an invalid image) formed on the other side of the paper is very similar to the image formed this time.

When the image is formed under the setting of the mode of using the back side of image-formed paper, a cross mark "x" may be placed on the invalid image, in order to prevent the error of taking the invalid image as the necessary image. However, as placing the cross mark "x" on each sheet of the paper is troublesome, this work is not practicable when a large number of sheets of paper having images formed on one side are used, in offices for example.

Further, under the setting of the concentration image formation mode, the conventional digital copying machine rotates the direction of the images to be formed in concentration based on the document set direction and the set number of images to be concentrated. Therefore, for stapling the sheets of paper, it is necessary to set the staple position based on the top and bottom directions of the image-formed paper. However, only the operator who frequently uses the concentration function and the staple function can understand to which direction the sheets of paper after the concentration are discharged, for each number of images to be concentrated. As a result, the functions of the digital copying machine are not effectively utilized at present.

SUMMARY OF THE INVENTION

According to the image formation apparatus of one aspect of the present invention, an image formation unit forms on a paper an image read from a document; and a guide information printing unit prints on the paper a guide information, which represents a layout of the document.

According to the image formation method of another aspect of the present invention, an image of a document is formed on a paper with an image formation unit; and a guide information, which represents a layout of the document, is printed on the paper with the image formation unit.

The computer program according to the present invention makes it possible to execute the image formation method according to the present invention on a computer, and the storage medium according to the present invention stores the computer program according to the present invention.

These and other objects, features and advantages of the present invention are specifically set forth in or will become apparent from the following detailed descriptions of the invention when read in conjunction with the accompanying drawings.

BRIEF DESCRIPTION OF THE DRAWINGS

FIG. 23 is a flowchart that schematically explains an image automatic recognition processing that the CPU executes based on a control program stored on the storage.

DETAILED DESCRIPTION

The first embodiment of the present invention will be explained with reference to FIG. 1 to FIG. 12. The embodiment of the image formation apparatus applied to the digital copying machine according to the first embodiment will be explained below.

Figure 1:
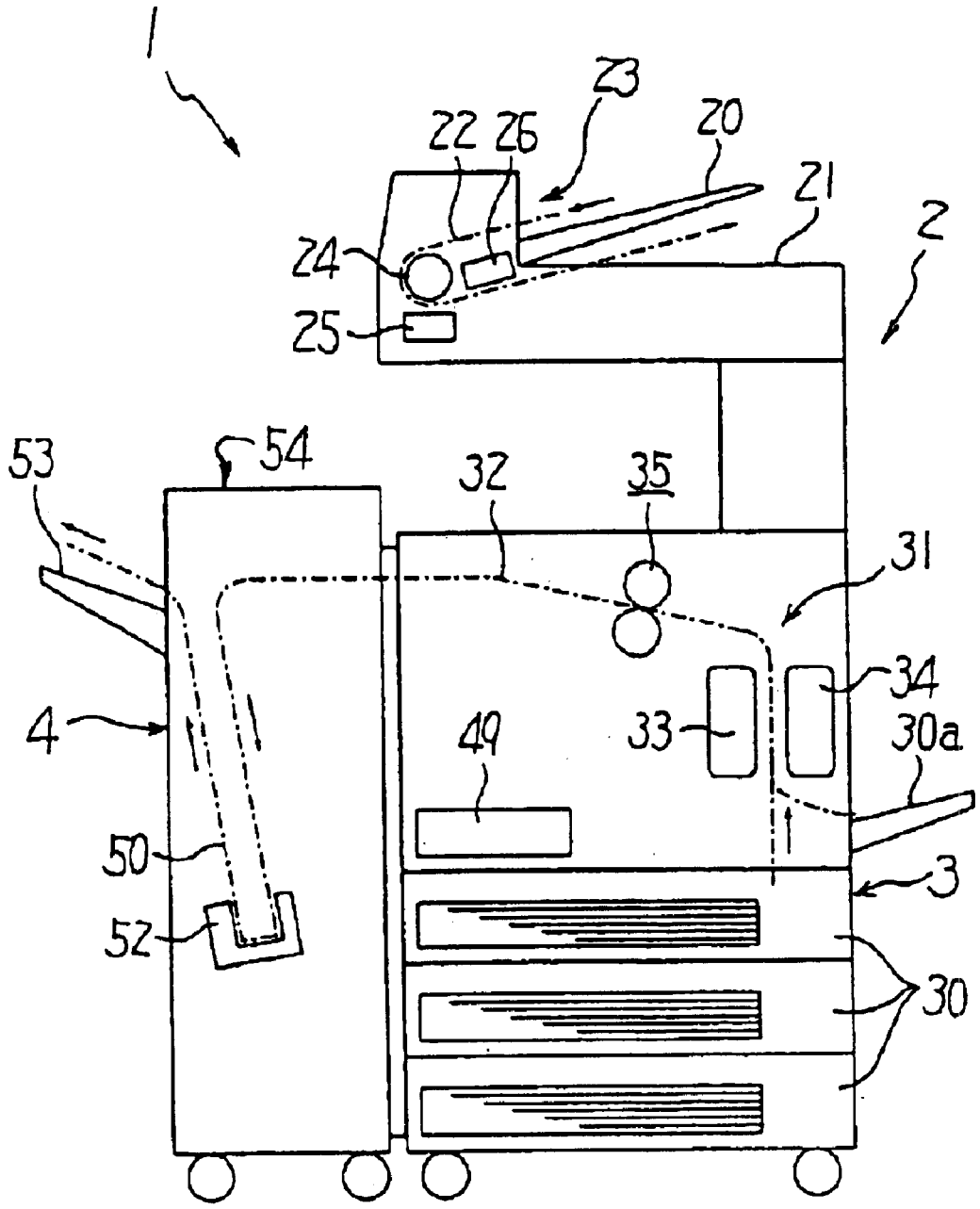
FIG. 1 is a vertical cross-sectional side view that shows a schematic structure of a digital copying machine according to the first embodiment of the present invention.
Figure 2:
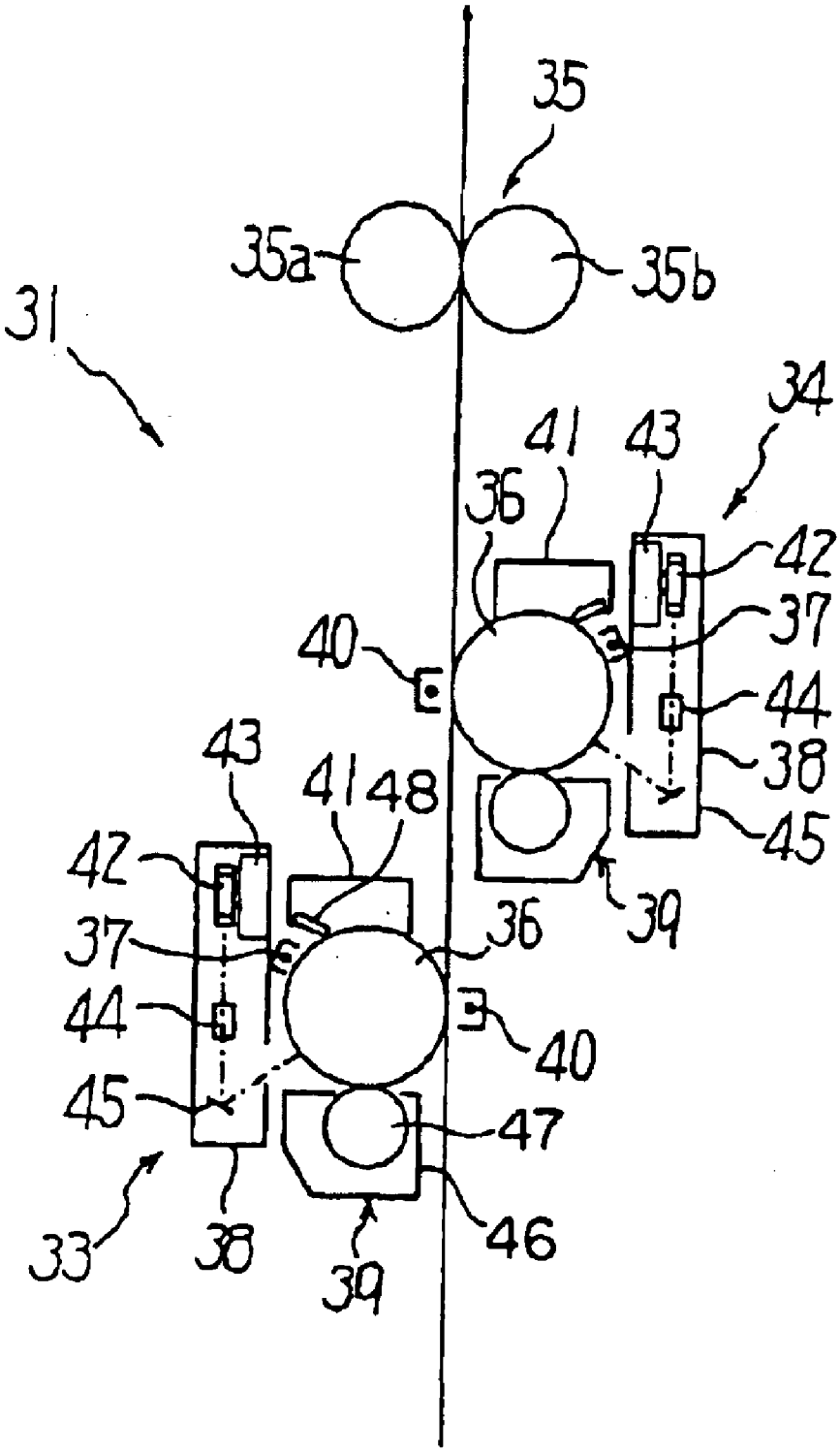
FIG. 2 is a vertical cross-sectional side view that shows a schematic structure of engines.

FIG. 1 is a vertical cross-sectional side view that shows a schematic structure of the digital copying machine according to the first embodiment of the present invention. A digital copying machine 1 comprises an image reading unit 2 that reads images from documents, an image formation unit 3 that forms images based on the image data of the documents read by the image reading unit 2, and a finisher unit 4 that staples the sheets of paper on which the images are formed by the image forming unit 3.

The image reading unit 2 will be explained first. The image reading unit 2 comprises a document setting table 20 on which sheets of documents are set, a document discharging table 21 to which the documents are discharged after forming the images, and an auto document feeder (ADF) 23 that has a document feeding path 22 extending from the document setting table 20 to the document discharging table 21.

On the document feeding path 22 of the ADF 23, there is provided a paper feeding mechanism that supplies document set on the document setting table 20 to the document feeding path 22 and carries the document to the document discharging table 21. This paper feeding mechanism includes a roller 24, and a motor not shown that drives the roller 24 to rotate.

On the document feeding path 22, there are provided a first scanner 25 that works as a first image reading mechanism, and a second scanner 26 that works as a second image reading mechanism. The first scanner 25 reads the image on the upward side (a temporary front side) of the document set on the document setting table 20, out of the documents that are fed through the document feeding path 22 by the document feeding mechanism. The second scanner 26 reads the image from the back side (a temporary back side) of the document set on the document setting table 20. As described later in detail, each of the first and second scanners 25 and 26 is composed of a light source 80 that irradiates the documents fed through the document feeding path 22, and a reading sensor 81 that optically reads the document images by receiving light reflected from the documents (refer to FIG. 7). A plurality of sensor chips 81*a* arrayed in a line in a sub-scanning direction are used as the reading sensor 81.

The document feeding mechanism feeds documents so that a distance between the image side of the document and the first scanner 25 and a distance between the image side of the document and the second scanner 26 are maintained constant respectively. Based on this arrangement, the first and second scanners 25 and 26 can read document images satisfactorily respectively.

In the image reading unit 2, the first scanner 25 optically reads the images from the temporary front sides of the documents, and the second scanner 26 optically reads the images from the temporary back sides of the documents, in the process that the ADF 23 sequentially feeds the sheets of documents. The images of the documents optically read by the first and second scanners 25 and 26 are converted into electric signals, which are used in the subsequent image processing.

The image formation unit 3 will be explained next. The image formation unit 3 comprises a paper feeding path 32 that is formed to extend from a plurality of paper supplying trays 30 that hold sheets of papers in layers to the finishing unit 4 via an engine section 31. A manual insertion tray 30*a* that holds sheets of paper in lamination by manual insertion communicates to the paper feeding path 32. In the present embodiment, sheets that have images already formed on the back sides respectively (hereinafter referred to as "back paper") are held in lamination on the manual insertion tray 30*a*. The paper feeding path 32 has a paper feeding mechanism not shown that feeds the sheets of paper on the paper feeding path 32 to the finisher unit 4.

In the present embodiment, in one of the paper supplying trays 30, sheets of paper are laminated such that the longitudinal direction of the sheets is the same as the paper feeding direction, that is, the sheets of paper are laminated in the vertical direction. In other paper supplying trays 30, sheets of paper are laminated such that the longitudinal direction of the sheets is orthogonal with the paper feeding direction, that is, the sheets of paper are laminated in the lateral direction.

It is possible to set paper of various sizes such as A4 type and B5 type, and paper of different kinds of material or thickness, on each of the paper supplying trays 30.

The engine section 31 comprises a first engine 33 as a first image formation mechanism that forms a toner image on one side of the paper (the front side of the paper), a second engine 34 as a second image formation mechanism that forms a toner image on the other side of the paper (the back side of the paper), and a fixing unit 35 that fixes toner images formed by the first and second engines 33 and 34 on the paper. The first and second engines 33 and 34 form the toner images on the paper based on the electronic photographing system respectively.

While the first and second engines 33 and 34 that form toner images on the paper based on the electronic photographing system are used as the first and second image formation mechanisms respectively in the present embodiment, the image formation mechanisms are not limited to this type. For example, it is also possible to form images based on various kinds of systems such as an inkjet system, a sublimation type heat transfer system, a silver salt photographing system, a fusion type heat transfer system, and the like.

The first and second engines 33 and 34 are based on a known technique, and therefore a detailed explanation will be omitted. Each of the first and second engines 33 and 34 is composed of a photo conductor 36, a charger 37 that is disposed around the photo conductor 36, an exposing unit 38, a developing unit 39, a copying unit 40, a cleaning unit 41, and the like.

A photosensitive layer formed with a charged substance consisting of an organic material, for example, is provided on the side of the photo conductor 36 that constitutes each of the first and second engines 33 and 34.

The charger 37 uniformly charges the surface of the photo conductor 36. As the charging system, there may be used a non-contact system for uniformly charging the surface of the photo conductor 36 by irradiating the surface of the photo conductor 36 with a charged lamp (shown in FIG. 2). It is also possible to use a contact system for uniformly charging the surface of the photo conductor 36 by applying a voltage to it in a state that a charged member such as a charged roller not shown is brought into contact with the photo conductor 36.

The exposing unit 38 forms an electrostatic latent image on the surface of the photo conductor 36 by scanning the photo conductor 36 uniformly charged with the charger 37, based on image formation data to be described later. The exposing unit 38 is composed of an exposure lamp that emits light, a polygon mirror 42 that scans the light emitted by the exposure lamp, a motor 43 that rotates the polygon mirror 42, and a mirror 45 that reflects the light scanned by the polygon mirror 42 to the photo conductor 36 via a lens 44. For the exposure lamp of the exposing unit 38, it is possible to use various kinds of light emitting sources such as a fluorescent lamp, a tungsten-filament lamp, a tungsten halogen lamp, a mercury vapor lamp, a sodium lamp, a light-emitting diode (LED), semiconductor laser (laser diode (LD)), electro-luminescence (EL), and the like. Although not particularly shown in the drawing, in the exposing unit 38, there may be provided various kinds of filters on the optical path of the light emitted from each light emitting source corresponding to the type of the light emitting source. With this arrangement, it is possible to irradiate only the light of a desired wavelength area emitted from each light emitting source, onto the photo conductor 36.

The developing unit 39 has a toner cartridge 46 that holds a toner, a developing roller 47 that makes the toner held by the toner cartridge 46 adhere to the photo conductor, and an agitator that agitates the toner held by the toner cartridge 46. The developing unit 39 generates a potential difference between the developing roller 47 and the photo conductor 36, thereby to make the toner held by the toner cartridge 46 adhere to the photo conductor 36.

The copying unit 40 is disposed opposite to the photo conductor 36 by sandwiching the paper feeding path 32 between the copying unit 40 and the photo conductor 36. By generating a potential difference between the copying unit 40 and the photo conductor 36, a toner image formed on the surface of the photo conductor 36 with the toner supplied from the developing roller 47 is transferred onto the paper.

The cleaning unit 41 scrapes, with a cleaning blade 48, a toner that remains on the surface of the photo conductor 36 after the toner image has been transferred by the copying unit 40. Thus, the cleaning unit 41 removes the remaining toner from the surface of the photo conductor 36.

The fixing unit 35 comprises a heating roller 35*a* and a pressing roller 35*b*. The heating roller 35*a* is connected to a power source not shown. Based on the power supplied from the power source, the heating roller 35*a* heats the paper that has passed through the first and second engines 33 and 34. The pressing roller 35*b* applies pressure to the paper heated by the heating roller 35*a*. As a result, the toner image transferred to the paper is fixed on the paper by the heating and pressing.

Figure 3:
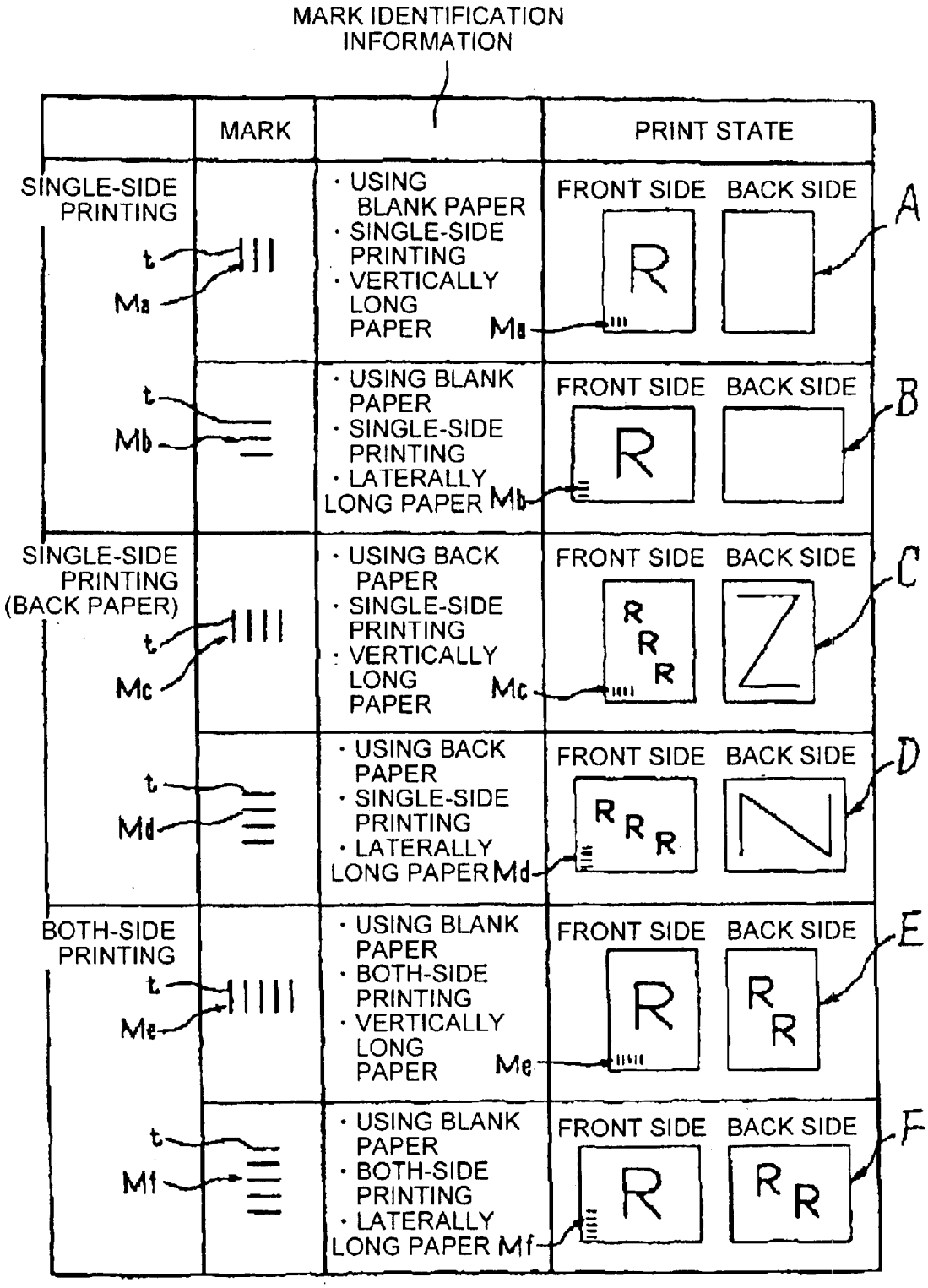
FIG. 3 is a relational view that schematically shows marks and documents attached with marks.

The image formation unit 3 incorporates an optical character reader (OCR) 49. As the OCR is a known art, a detailed explanation of this will be omitted. The OCR 49 is a data input unit that directly optically reads characters formed on the paper. In the present embodiment, the OCR 49 recognizes guide information that is provided according to predetermined rules. For example, the OCR 49 recognizes a type of guide information and a direction by using a pattern matching method as a known technique. In the present embodiment, marks Ma, Mb, Mc, Md, Me, and Mf shown in FIG. 3 are used as pieces of guide information.

The marks Ma, Mb, Mc, Md, Me, and Mf that are formed in the multi-functional image formation processing to be described later will be explained with reference to FIG. 3. In the present embodiment, the marks Ma, Mb, Mc, Md, Me, and Mf are provided based on the following rules. FIG. 3 schematically shows a relationship between the marks Ma, Mb, Mc, Md, Me, and Mf that are used in the digital copying machine 1 of the present embodiment and documents that are attached with the marks Ma, Mb, Mc, Md, Me, and Mf based on the rules. As is clear from FIG. 3, the marks Ma, Mb, Mc, Md, Me, and Mf are structured by combining a plurality of rectangular chip marks t of which shapes and sizes are determined in advance. In the present embodiment, the marks Ma, Mb, Mc, Md, Me, and Mf are formed by arranging "three", or "four", or "five" chip marks t.

The marks Ma and Mb as first guide information formed by using three chip marks t are attached on the paper when an image is to be formed on one side of the paper that has two blank sides. The marks Mc and Md as second guide information formed by using four chip marks t are attached on the paper when an image is to be formed on the other side of the back paper. The marks Me and Mf as third guide information formed by using five chip marks t are attached on the paper when images are to be formed on both sides of the paper.

Each of the marks Ma, Mb, Mc, Md, Me, and Mf is attached to the left lower end of the paper in a state that the top and bottom directions of the image are arranged. The "state that the top and bottom directions of the image are arranged" means a state that the top-and-bottom and left-and-right positional relationship of an image such as a character is defined as constant from the viewpoint of the operator so that the image of which top-and-bottom and left-and-right positional relationship of the image can be visually determined as constant is correctly guided to the operator who looks at the image. In the present embodiment, the state that the marks Ma, Mb, Mc, Md, Me, and Mf are at the left lower end position of the paper is the state that the top and bottom directions of the paper are correctly set according to the formed images.

The marks Ma, Mb, Mc, Md, Me, and Mf are attached to the paper so that the longitudinal directions of the chip marks t become parallel to the long side of the paper. As shown by A, C and E in FIG. 3, the paper in which the top and bottom directions of the image and the longitudinal direction of the paper are in the same directions is called "vertically long paper". As shown by B, D and F in FIG. 3, the paper in which the top and bottom directions of the image and the longitudinal direction of the paper cross each other is called "laterally long paper". Based on these definitions, in the vertically long paper, the layout direction of the chip marks t in the state that the top and bottom directions of the image are arranged becomes the same as the longitudinal direction of the paper. In the laterally long paper, the layout direction of the chip marks t in the state that the top and bottom directions of the image are arranged becomes the direction that is orthogonal with the longitudinal direction of the paper.

Each of the marks Ma, Mb, Mc, Md, Me, and Mf is attached to only the front side of the paper. Based on this arrangement, it is possible to know the state of the back side of the document without looking at the back side, regardless of the image formation mode in the multi-functional image formation processing to be described later.

When marks are formed on both the front and back sides of a single document, priority is placed to the mark Mc, Md, Me or Mf that has a larger number of chip marks t, as the basis for making a decision.

Based on this arrangement, when an image is to be formed on the blank side of the back paper, the mark Mc or Md is attached to the paper for the image to be formed this time, although the mark Ma or Mb is attached to the image formed previously on the back side. Therefore, it is possible to easily decide which side is the front side, based on the image data already read by the first and second scanners 25 and 26.

The OCR 49 stores in advance the standard patterns of the six kinds of marks Ma, Mb, Mc, Md, Me, and Mf shown in FIG. 3. The OCR 49 can recognize the marks Ma, Mb, Mc, Md, Me, and Mf included in the read image data, based on the stored standard patterns in the multi-functional image formation processing to be described later.

The recognition method of the OCR 49 is not limited to the pattern matching method, and it is also possible to use other known method such as structural analysis method.

The finisher unit 4 will be explained next. The finisher unit 4 comprises a finisher path that guides the paper discharged from the image formation unit 3 to a paper discharge tray 53 via a stack tray 50. The finisher path comprises a paper feeding mechanism not shown that feeds the paper discharged from the image formation unit 3 to the paper discharge tray 53. On the stack tray 50, a plurality of sheets of paper that are formed with images by the image formation unit 3 are temporarily stacked. The stack tray 50 comprises a jogger 51 (refer to FIG. 6) that arranges the stacked sheets of paper in order, and a stapler 52 that staples a stacked bundle of paper. The finisher unit 4 is also provided with a sorter 54 (refer to FIG. 6) that sorts the sheets of paper discharged from the image formation unit 3.

The stapler 52 can rotate by 180 degrees in the front and back directions of the paper in FIG. 1 along the edge of the paper stacked on the stack tray 50. Based on this, the stapler 52 can staple the paper stacked on the stack tray 50, at the lower side, right side, left side, and at the corner between the lower side and the right side, and at the corner between the lower side and the left side, of the paper respectively (refer to 632 in FIG. 5).

Figure 4:
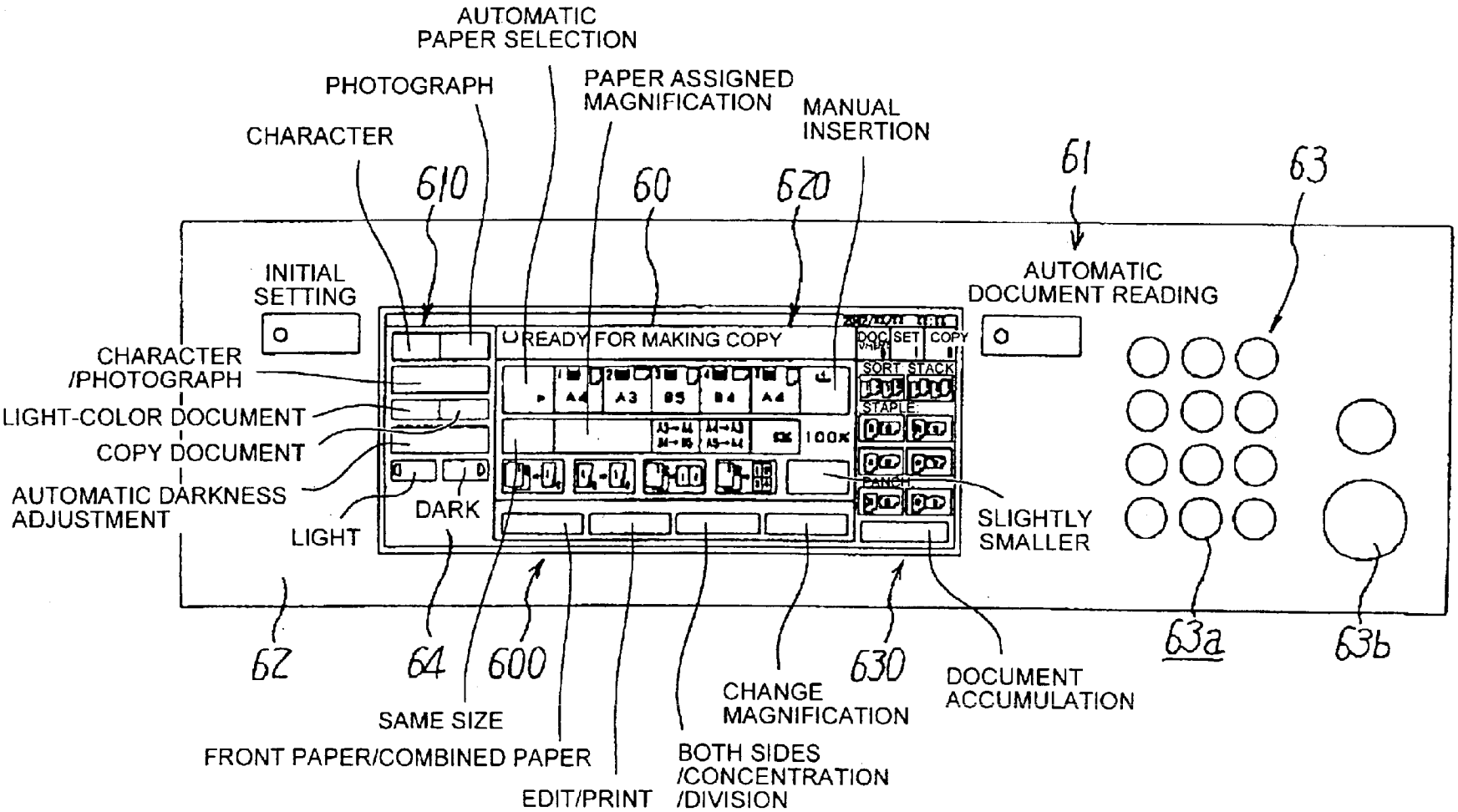
FIG. 4 is a top plan view of a control panel.

The digital copying machine 1 comprises a control panel 62 consisting of a display section 60 and a console section 61, as shown in FIG. 4. The display section 60 is composed of a liquid crystal display (LCD, attached with the reference numeral 60 in the subsequent explanation). The console section 61 is composed of a hard key 63 that includes ten keys 63*a* and a start key 63*b*, and a touch panel 64 laminated on the LCD 60. By operating the touch panel 64, it is possible to input various kinds of information corresponding to display contents.

Figure 5:
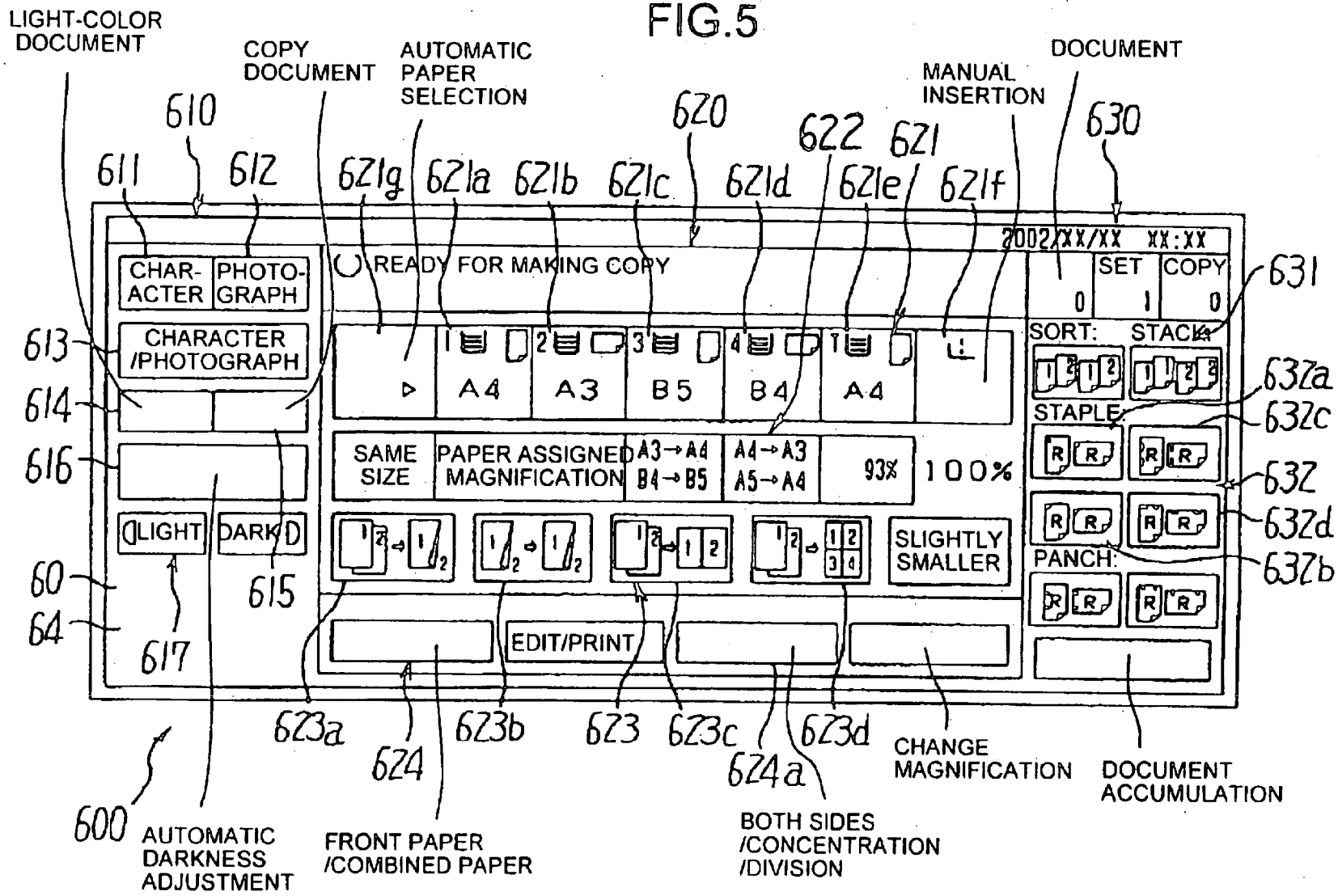
FIG. 5 is a front view of a queue screen.

The LCD 60 displays contents such as, for example, a queue screen 600 that is displayed in a normal queue state, as shown in FIG. 5. On the queue screen 600, key illustrations that show positions of various kinds of operation keys are displayed for each section, as shown in FIG. 5. A reading condition setting section 610 has keys laid out to set the operation mode of the image reading unit 2. An image formation condition setting section 620 has keys laid out to set the operation mode of the image formation unit 3. A finisher condition setting section 630 has keys laid out to set the operation mode of the finisher unit 4.

The reading condition setting section 610 displays various kinds of illustrations that guide various keys of positions. A "character document key" 611, a "photograph document key" 612, a "character/photograph mixed document key" 613, a "light color document key" 614, and a "dark color document" 615 are used to set reading conditions following the image state of the document such as a "character document", a "photograph document", a "character/photograph mixed document", a "light color document", and a "dark color document" respectively. The reading condition setting section 610 displays various kinds of illustrations that guide various key positions. An "automatic density key" 616 is used to automatically set the reading density of the document. A "manual density key" 617 is used to manually set the reading density of the document.

The image formation condition setting section 620 displays various kinds of illustrations that guide various key positions. A "paper selection key" 621 is used to select one of a plurality of paper supply trays 30 on which various kinds of paper are held in lamination, having different paper directions such as a vertical direction and a lateral direction, and different paper sizes such as A4 and B5 sizes, respectively. A "scale key" 622 is used to assign a scale of enlargement/compression of an image. An "image formation mode selection key" 623 is used to set a part of an image formation mode with one touch.

The "paper selection key" 621 is composed of various keys. Keys of "regular size assignment keys" 621*a* to 621*e* are used to assign paper of regular sizes such as "A4", "A3", and "B5". A "manual insertion paper assignment key" 621*f* is used to assign paper that are laminated on the manual insertion tray 30*a*. An "automatic paper selection key" 621*g* is used to automatically set a type of paper. In the present embodiment, whether the paper to be used in the single-side image formation mode is both-side blank paper or back paper is set based on the presence or absence of the operation of the "manual insertion paper assignment key" 621*f*. Therefore, by using the "manual insertion paper assignment key" 621*f*, it is possible to realize the paper mode setting unit and the paper mode setting function. By touching the "regular size assignment keys" 621*a* to 621*e*, it is possible to assign the vertically long paper/laterally long paper, as well as the paper sizes.

The image formation mode that is set by touching the "image formation mode selection key" 623 includes a single-side image formation mode of forming a read image on one side of the paper, and a two-side image formation mode of forming read images on both sides of the paper. In the present embodiment, the image formation mode is set by touching the "image formation mode selection key" 623. Therefore, by using the "image formation mode selection key" 623, it is possible to realize the image formation mode setting unit and the image formation mode setting function.

Further, the image formation mode that is set by touching the "image formation mode selection key" 623 also includes a concentration image formation mode (concentration mode) for forming images of a set number of images to be concentrated on one side of paper by compressing/rotating a plurality of read images.

The image formation condition setting section 620 displays various kinds of illustrations that guide positions of an "individual setting key" 624 for individually setting the image formation modes. It is also possible to set the image formation modes by touching the "individual setting key" 624.

The finisher condition setting section 630 displays various kinds of illustrations that guide positions of various keys. A "discharge assignment key" 631 is used to assign a discharge state of the paper such as sorting and stacking. A "staple position assignment key" 632 is used to set various staple positions at the time of stapling paper under the setting of a staple mode. The staple mode means an operation mode of stapling the paper formed with images by the image formation unit, at set positions. The "staple position assignment key" 632 is composed of "staple position setting keys" 632*a*, 632*b*, 632*c*, and 632*d* that show states that the paper formed with images are stapled at the upper end, the left end, the left upper end (side), the left upper end (slant), respectively. In the present embodiment, the LCD 60 displays illustration of the stapled paper to facilitate the understanding of the staple position. In the present embodiment, the staple positions are set by touching the "staple position setting keys" 632*a*, 632*b*, 632*c*, and 632*d*. Therefore, by using the "staple position setting keys" 632*a*, 632*b*, 632*c*, and 632*d*, it is possible to realize the staple position setting unit and the staple position setting function.

For example, it is possible to set the single-side image formation mode or the both-side image formation mode, by touching either a "both-side image formation mode setting key" 623*a* or a "single-side image formation mode setting key" 623*b* of the "image formation mode selection key" 623. Further, it is possible to set the concentration mode of concentrating images of two sheets or four sheets of documents onto one side of a sheet of paper, by touching either a "two-side concentration setting key" 623*c* or a "four-side concentration setting key" 623*d* of the "image formation mode selection key" 623. In the present embodiment, the concentration mode is set by touching the "two-side concentration setting key" 623*c* or the "four-side concentration setting key" 623*d* of the "image formation mode selection key" 623. Therefore, by using the "two-side concentration setting key" 623*c* or the "four-side concentration setting key" 623*d* of the "image formation mode selection key" 623, it is possible to realize the concentration mode setting unit and the concentration mode setting function.

In the present embodiment, illustrations that show a relationship between the document and the image-formed paper are displayed respectively for only the setting of high setting frequency. Therefore, it is possible to set various values by touching the model keys.

It is possible to set the image formation mode and the concentration mode that are other than the setting displayed by the model keys, as follows. A "both-side/concentration/division" key 624*a* of the "individual setting key" 624 displayed on the LCD 60 is touched, thereby to make display of a both-side/concentration/division mode setting screen not shown. Based on the displayed both-side/concentration/division mode setting screen, the touch panel 64 is operated to set various kinds of image formation modes, and select a setting of a concentration mode, and a number of images to be concentrated.

For setting a staple mode, one of the "staple position setting keys" 632*a*, 632*b*, 632*c*, and 632*d* of the "staple position assignment key" 632 is selectively touched. A staple "YES" is set, and a staple position is assigned. At this time, the LCD 60 displays illustrations of stapled paper to enable the operator to visually recognize the staple position. As it is possible to set a desired stapling state by selecting the illustration, the operator can understand the image of the actual staple position, which restricts the occurrence of stapling at a wrong position.

Figure 6:
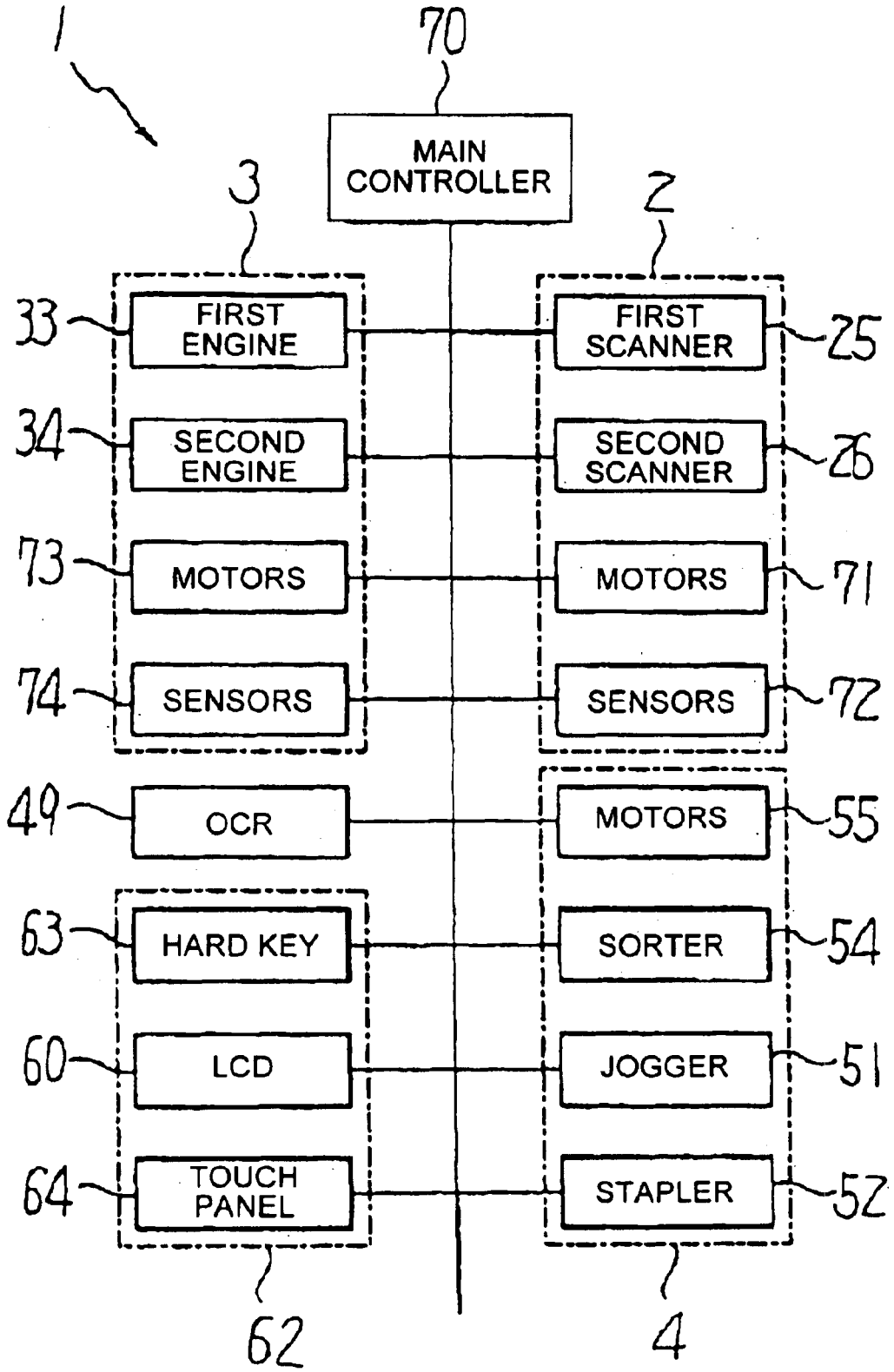
FIG. 6 is a block diagram that shows an electric connection of a control system of the digital copying machine.

Electric connection of the control system of the digital copying machine 1 will be explained next with reference to FIG. 6. FIG. 6 is a block diagram that shows the electric connection of the control system of the digital copying machine 1. The digital copying machine 1 comprises a main controller 70 that integrally controls all sections. Although not shown in FIG. 6, the main controller 70 comprises a microcomputer having a read-only memory (ROM), a random access memory (RAM), and the like connected to a central processing unit (CPU). The CPU integrally controls the driving of the sections of the digital copying machine 1. The ROM stores control programs, and the RAM functions as a work area of the CPU.

Figure 8:
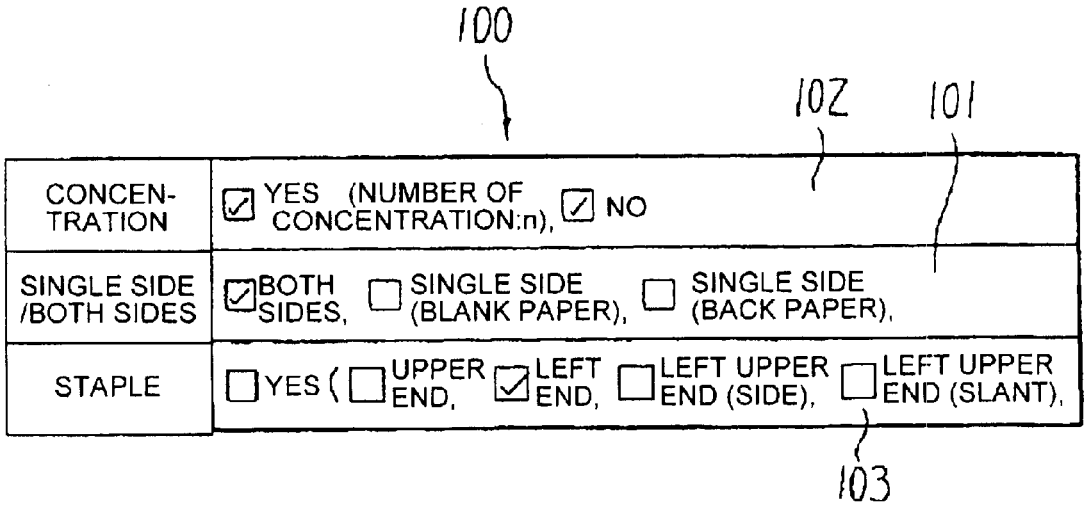
FIG. 8 is an explanatory diagram that shows an area structure of a user setting area.

The RAM of the main controller 70 has a user setting area 100 (refer to FIG. 8) that is referred to in the multi-functional image formation processing to be described later. The user setting area 100 includes an image formation mode setting area 101 in which single-side/both-side image formation modes are set, a concentration mode setting area 102 in which a selection of a concentration mode is set, and a staple mode setting area 103 in which a selection of a staple mode is set. The operator operates the hard key 63 and the touch panel 64 to set various values in the user setting area 100, based on the various display contents of the queue screen 600 displayed on the LCD 60. FIG. 8 shows the following setting as an example. For the image formation mode, the both-side image formation mode is selected. For the concentration mode, "YES" is selected, and "n" is selected as the number of images to be concentrated. For the staple mode, "YES" is selected, and the "left end position" is selected for the staple position.

Either the single-side image formation mode or the both-side image formation mode is selected in the image formation mode setting area 101. When none of the image formation mode is set until when the start key 63*b* is touched in the multi-functional image formation processing to be described later, the single-side image formation mode is set as default on the image formation mode setting area 101.

The concentration mode is an operation mode of forming images of a set number of images to be concentrated on one side of paper by compressing/rotating a plurality of read images. Therefore, when "YES" is set to the concentration mode in the concentration mode setting area 102, it is necessary to set the mode following the number of images to be concentrated that shows the number of images to be formed on one side of the paper. When the concentration mode is not set until when the start key 63*b* is touched in the multi-functional image formation processing to be described later, "NO" is set to the concentration mode as default on the concentration mode setting area 102.

The staple mode is an operation mode in which the images formed by the image formation unit 3 are stapled at a set position. Therefore, when "YES" is set to the staple mode in the staple mode setting area 103, it is necessary to set the mode by matching the staple position. One of the upper end, left end, and left upper end is set to the staple position, based on the top and bottom directions after the image formation. When the staple mode is not set until when the start key 63*b* is touched in the multi-functional image formation processing to be described later, "NO" is set to the staple mode as default on the staple mode setting area 103.

Figure 9:
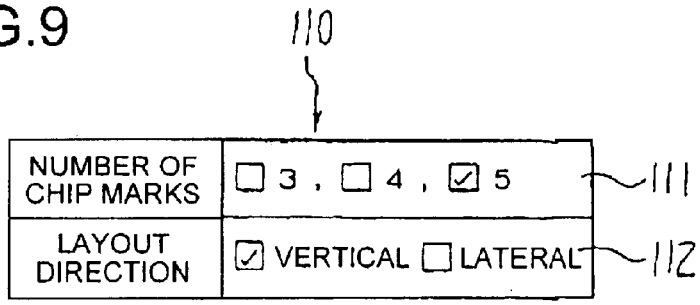
FIG. 9 is an explanatory diagram that shows a structure of an image formation condition setting area.

The RAM of the main controller 70 has an image formation condition setting area 110 (refer to FIG. 9) in which an image formation condition is set in the both-side image formation processing (refer to FIG. 11) or the single-side image formation processing (refer to FIG. 12) to be described later. The image formation condition setting area 110 has a chip mark number setting area 111 in which the number of chip marks t to be formed on the paper is set depending on whether the image formation mode set in the image formation mode setting area 101 is the single-side image formation mode or the both-side image formation mode. When the image formation mode set in the image formation mode setting area 101 is the single-side image formation mode, the number of chip marks t to be set on the chip mark number setting area 111 is determined according to the setting of blank paper/back packer based on the above-described principles. Further, the image formation condition setting area 110 also has a layout direction setting area 112 in which it is set whether the set chip mark number is in the vertical direction or the lateral direction with respect to the top and bottom directions of the images. FIG. 9 shows an example that the number of chip marks is set to "five", and the layout direction is set to the "vertical" direction.

The RAM of the main controller 70 further has a read image memory 88 (refer to FIG. 7) that temporarily stores image data read by the image reading unit 2 in the multi-functional image formation processing to be described later, and an image data developing area not shown in which the data of the image to be formed on the paper (image formation data) is developed.

Further, the main controller 70 has a storage not shown that stores various kinds of application programs in the multi-functional image formation processing to be described later. The storage stores various application programs, and pattern data of invalid marks Mz (refer to FIG. 3) that show that the image becomes invalid (an invalid image) when the back paper is used in the multi-functional image formation processing to be described later.

The main controller 70 can control the driving of sections of the digital copying machine 1, when the control program and the like stored in the ROM and the storage are written into the RAM at the starting time of the digital copying machine 1. Connection and operation of the sections of which driving the main controller 70 controls will be explained next.

Figure 7:
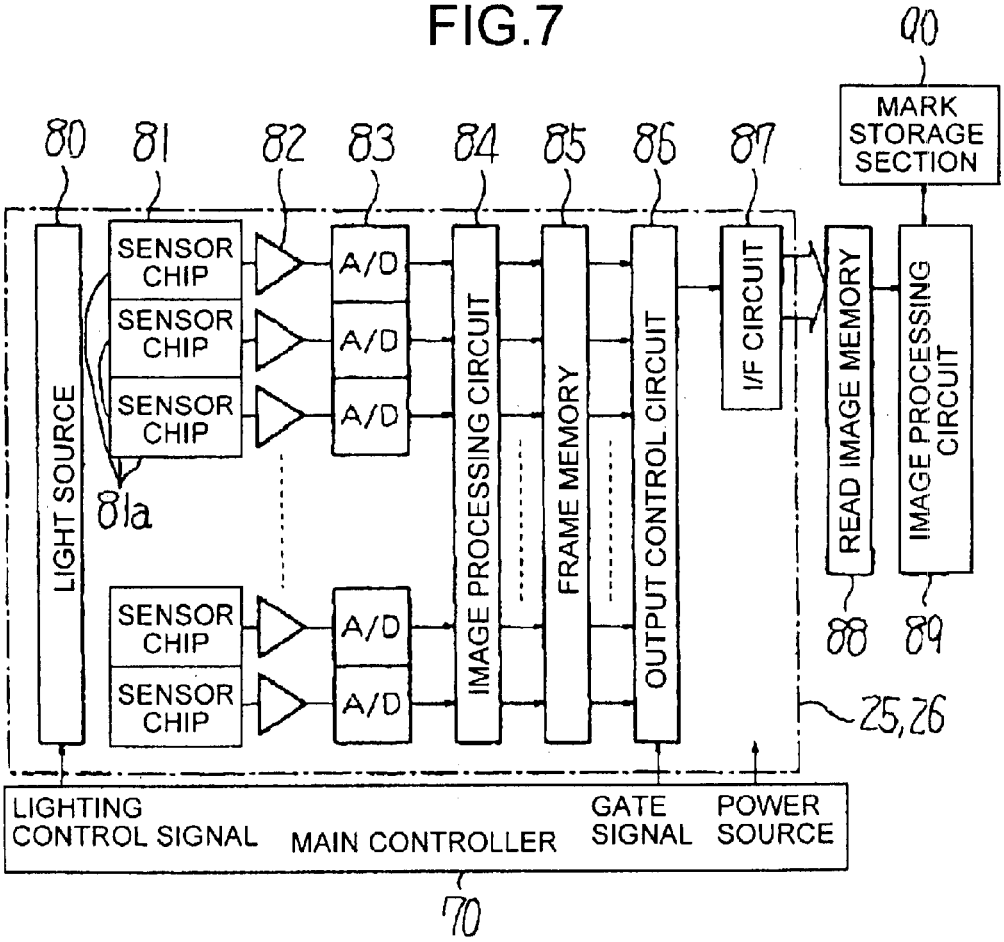
FIG. 7 is a block diagram that shows an electric connection of a first scanner and a second scanner of an image reading unit.

The first and second scanners 25 and 26 are connected to the main controller 70 via an I/F circuit (refer to FIG. 7). Further, motors 71 that drive the paper feeding mechanism, and sensors 72 that detect a size of document set in the document setting table and jams in the document feeding path are connected to the main controller 70 via input/output units not shown.

The image reading unit 2 drives the motors 71 according to the control of the main controller 70, thereby to read images from the documents that are fed to the first and second scanners 25 and 26 based on output values of the sensors 72.

The image reading operation of the first and second scanners 25 and 26 of the image reading unit 2 will be explained next with reference to FIG. 7. FIG. 7 is a block diagram that shows the electric connection of the first and second scanners 25 and 26 of the image reading unit 2. The first and second scanners 25 and 26 turn on the light source 80 based on a lighting control signal from the main controller 70.

The document reflects the light emitted from the light source 80. A lens not shown condenses the light. The condensed light is incident to the sensor chips 81*a* of the reading sensor 81. The light reflected from the document and is incident to the reading sensor 81 is photoelectrically converted into analog image data having a voltage corresponding to the intensity of the light incident to each sensor chip 81*a*. An amplifier circuit 82 amplifies this analog image data, and inputs the amplified analog image to an analog/digital (A/D) converter circuit 83. The A/D converter circuit 83 converts the input analog read image data into digital data. A frame memory 85 temporarily stores the digital read image data obtained based on the A/D conversion via an image processing circuit 84. In the present embodiment, the image processing circuit 84 obtains digital image data of a plurality of lines that are incident to the sensor chips 81*a* within a predetermined range from both ends of a sub-scanning direction from the start of the reading, as image data for the OCR 49 to carry out analysis and pattern matching, in the multi-functional image formation processing to be explained later. The frame memory 85 stores the image data obtained by the image processing circuit 84 for the OCR 49 to carry out the analysis and the pattern matching, separate from other read image data. An output control circuit 86 transfers the read image data temporarily stored in the frame memory 85 from an I/F circuit 87 to the read image memory 88 in synchronism with a gate signal from the main controller 70.

The read image memory 88 temporarily stores the transferred read image data. An image processing circuit 89 carries out various kinds of image processing to the read image data such as a black shading correction, a white shading correction, and a γ correction. As the image processing such as the black shading correction, the white shading correction, and the γ correction carried out to the read image data temporarily stored in the read image memory 88 is a known technique, a detailed explanation of these processing will be omitted. A mark storage section 90 that stores the marks Ma, Mb, Mc, Md, Me, and Mf is connected to the image processing circuit 89 in the present embodiment. The image processing circuit 89 suitably obtains any one necessary mark from among the marks Ma, Mb, Mc, Md, Me, and Mf that are stored in the mark storage section 90, and combines the obtained mark with the read image data processed, in the multi-functional image formation processing to be described later.

The first and second engines 33 and 34 are connected to the main controller 70 via input/output units not shown. The main controller 70 controls the driving of the first and second engines 33 and 34 based on the image data read and processed by the image reading unit 2. Based on this control, each of the first and second engines 33 and 34 rotates the photo conductor 36, and controls the driving of the charger 37, the exposing unit 38, the developing unit 39, the copying unit 40, the cleaning unit 41, and the like.

Further, motors 73 that drive the paper feeding mechanism not shown of the image formation unit 3 and the rollers 35*a* and 35*b* of the fixing unit 35, and sensors 74 that detect positions of paper in the paper feeding path 32 and jams, are connected to the main controller 70 via input/output units not shown. The first and second engines 33 and 34 control the driving of the motors 73 and the sensors 74 by matching the timing with the operation of the first and second engines 33 and 34, based on control signals from the main controller 70. Although not particularly shown in the drawing, the main controller 70 also controls the driving of the power source to match the timing of power supply to the heating roller 35*a* of the fixing unit 35.

Based on the above, the images read by the image reading unit 2 are formed on the paper, thereby to carry out the copying of the document images.

The OCR 49 is also connected to the main controller 70 via input/output units not shown. The OCR 49 recognizes the marks Ma, Mb, Mc, Md, Me, and Mf from the image data read by the first and second scanners 25 and 26, according to the patterning method.

The LCD 60, the hard key 63, and the touch panel 64 are also connected to the main controller 70 via input/output units not shown. The LCD 60 displays various kinds of setting screens (refer to FIG. 5) based on display data that is output from the main controller 70. The console section 61 outputs signals corresponding to the positions operated on the hard key 63 and the touch panel 64, to the main controller 70.

The sorter, the jogger 51, and the stapler 52 of the finisher unit 4, and motors 55 that drive the paper feeding mechanism not shown for feeding the paper discharged from the image formation unit 3 to the discharge tray 53, are also connected to the main controller via input/output units not shown.

Figure 10:
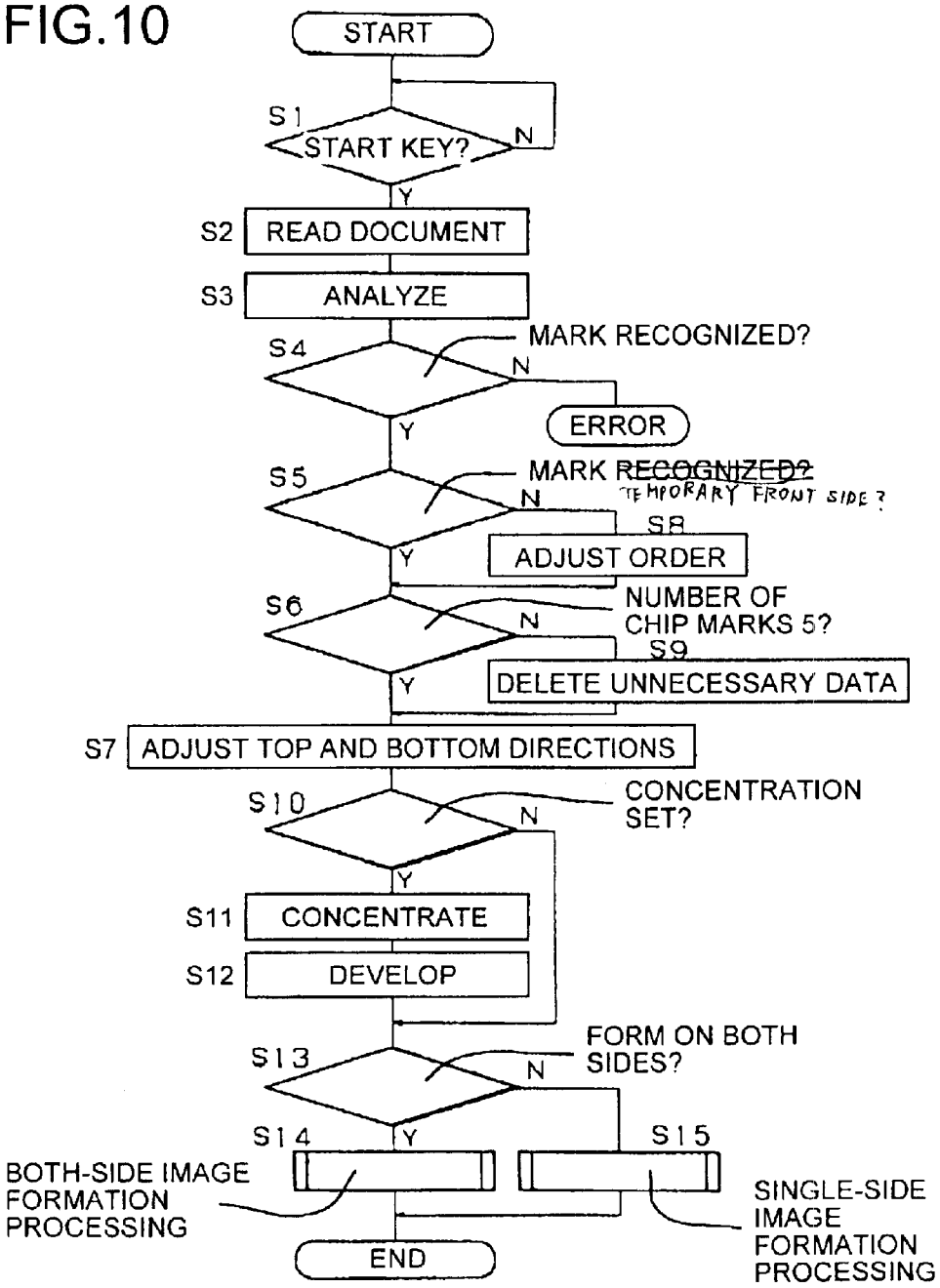
FIG. 10 is a flowchart that schematically explains a multi-functional image formation processing that the CPU executes based on a control program stored in a storage.

The multi-functional image formation processing that the CPU executes based on the control program stored in the storage of the main controller 70 will be explained next with reference to FIG. 10 to FIG. 12. FIG. 10 is a flowchart that schematically explains the multi-functional image formation processing that the CPU executes based on the control program stored in the storage. The multi-functional image formation processing is executed based on the condition that various kinds of setting in the user setting area 100 have been completed based on the operator's key operation. However, when no setting has been made in the user setting area 100, the multi-functional image formation processing is executed based on the default explained above.

In the multi-functional image formation processing, the CPU waits for the starting of the operation until when it is decided that the operator has touched the start key 63*b* (N at step S1). When it is decided that the operator has touched the start key 63*b* (Y at step S1), the image reading unit 2 operates to read images from both sides of the document (S2). The function of the image reading unit is executed at this time.

The first and second scanners 25 and 26 optically read the images from the documents, and convert the read images into electric signals. The read image memory 88 temporarily stores the electric signals. Th CPU processes the read image data temporarily stored in the read image memory 88 as follows. The CPU processes the image data read from the temporary front side by the first scanner 25, and the image data read from the temporary back side by the second scanner 26 following the image data read from the temporary front side, as a pair as the read image data of one sheet of document.

The OCR 49 analyzes each image data of a predetermined range (eight positions as a total of the front and back sides of the document) stored in the frame memory 85, for each sheet of document, out of the image data read (S3). The CPU carries out a pattern matching. The CPU decides which one of the pattern-matched image data includes any one of the mark Ma, Mb, Mc, Md, Me, or Mf (S4). The CPU executes the guide presence/absence deciding unit and the guide presence/absence deciding function at this time.

As explained above, at step S4, the CPU decides which one of the read image data of the predetermined range of four corners (eight positions as the total of the front and back sides of the document) includes any one of the marks Ma, Mb, Mc, Md, Me, and Mf. Therefore, the CPU executes the direction recognizing unit and the direction recognizing function at this time.

Further, at step S4, it is possible to decide the type of any one of the marks Ma, Mb, Mc, Md, Me, and Mf that is included in the image data, by carrying out the pattern matching to each image data. Therefore, the CPU executes the guide type deciding unit and the guide type deciding function at this time.

When it is decided that the read image data includes any one of the marks Ma, Mb, Mc, Md, Me, and Mf (Y at S4), the CPU decides for each document whether the mark Ma, Mb, Mc, Md, Me, or Mf is included in the image data of the temporary front side or in the image data of the temporary back side (S5).

When it is decided that the image data does not include any one of the marks Ma, Mb, Mc, Md, Me, and Mf (N at S4), the CPU decides that an error occurred, and the CPU carries out an error processing. For example, the LCD 60 displays an error message, or the CPU interrupts the multi-functional image formation processing.

When it is decided that the image data of the temporary front side includes the mark Ma, Mb, Mc, Md, Me, or Mf (Y at S5), the CPU decides whether the recognized mark is the mark Me or Mf that is formed with five chip marks t (S6).

When it is decided that the recognized mark is the mark Me or Mf that is formed with five chip marks t (Y at S6), the CPU decides that the document is a both-side printed document and it is necessary to read images from both sides of the document. Based on the type and position of the mark Me or Mf included in the image, the CPU adjusts the top and bottom directions of the image data read from both sides of the document (S7).

When it is decided that the image data of the temporary back side includes any one of the marks Ma, Mb, Mc, Md, Me, and Mf (N at S5), the CPU changes the order of the read image data (S8). Then, the process proceeds to step S6.

At step S8, the CPU changes the order of the read image as follows. The CPU changes the order of the data read from the temporary front side and the data read from the temporary back side, sequentially for each document. In other words, of the image data read at step S2, the image data read last time from the temporary back side of the document becomes the image data read first from the front side of the document. Also, the image data read last time from the temporary front side of the document becomes the image data read first from the back side of the document.

When it is decided that the recognized mark is the mark Ma, Mb, Mc, or Md that is formed with three or four chip marks t (N at S6), the CPU decides that, of the image data read from both sides of each document, the read image data that does not include the mark Ma, Mb, Mc, or Md is unnecessary read image data, and deletes this data (S9). The process then proceeds to step S7.

Based on the above operation, even when the front and back sides of the document are set wrong on the document setting table 20, it is possible to selectively use the read image data to form the images by judging the necessary read image data based on the mark Ma, Mb, Mc, or Md. As a result, it is possible to prevent waste of paper due to the formation of unnecessary images.

When the mark Ma or Mb formed with three chip marks t and the mark Mc or Md formed with four chip marks t are recognized in the image data of one document, the CPU decides that the image data read from the side that includes the mark Ma or Mb formed with three chip marks t is the unnecessary image data, and deletes this data.

Next, the CPU decides whether the concentration mode has been set to "YES", by referring to the user setting area 100 (S10).

When it is decided that the concentration mode has been set to "YES" by referring to the user setting area 100 (Y at S10), the CPU concentrates the read image data based on the number of images to be concentrated obtained by referring to the concentration mode setting area 102 (S11). The CPU develops the concentrated read image data into the image data developing area as the image formation data (S12).

In the concentration processing, at step S11, the CPU adjusts the sizes and directions of the read image data so that the read image data of the number for concentration set by the operator in advance is formed on one side of the paper. Because of the known technique, a detailed explanation of this processing will be omitted. The CPU decides presence or absence of a guide. In the concentration processing, the CPU adjusts the directions of the read image data so that the top and bottom directions of the images formed on one side of the paper are all equal. The direction adjusting function of concentration is realized at this time.

On the other hand, when it is decided that the concentration mode has not been set by referring to the user setting area 100 (N at S10), the CPU develops the read image data not concentrated onto the image data developing area as the image formation data (S12).

Next, the CPU decides whether the both-side image formation mode of forming images on both sides of the paper has been set, by referring to the user setting area 100 (S13).

Figure 11:
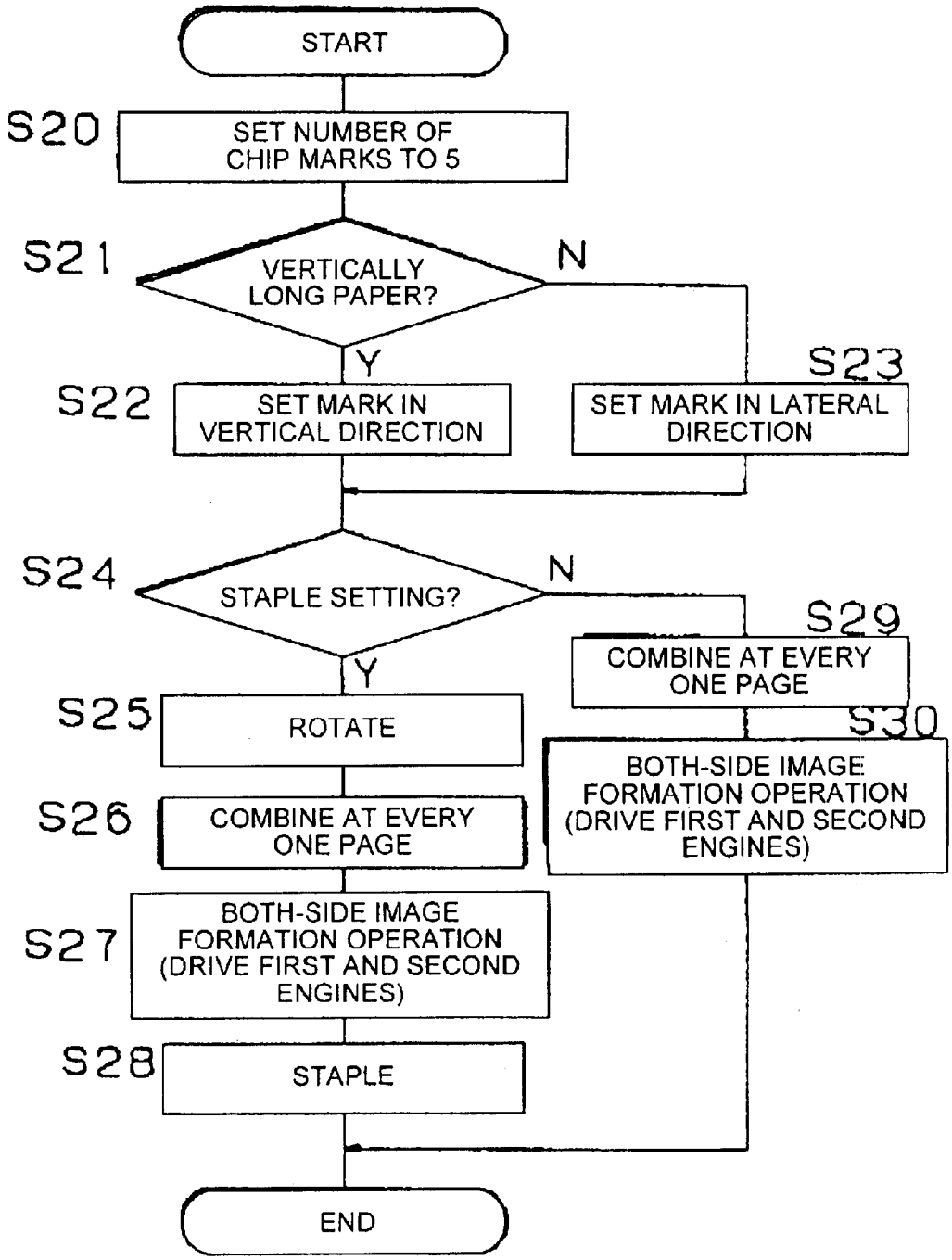
FIG. 11 is a flowchart that schematically explains a both-side image formation processing that the CPU executes based on a control program stored in the storage.

When it is decided that the both-side image formation mode of forming images on both sides of the paper has been set by referring to the user setting area 100 (Y at S13), the CPU executes the both-side image formation processing shown in FIG. 11 (S14). When it is decided that the single-side image formation mode of forming an image on one side of the paper has been set by referring to the user setting area 100 (N at S13), the CPU executes the single-side image formation processing shown in FIG. 12 (S15). The multi-functional image formation processing finishes there. At steps S14 and S15, the function of the image formation unit is executed. Also, at steps S14 and S15, the guide information formation unit, the guide information formation function, and the guide information formation function by type of mode are executed. At steps S14 and S15, the CPU forms on the paper only the valid image after deleting the unnecessary image at step S9. Therefore, the valid image formation function is realized.

Next, the both-side image formation processing to be executed at step S14 will be explained with reference to FIG. 11. FIG. 11 is a flowchart that schematically explains the both-side image formation processing that the CPU executes based on the control program stored in the storage. In the both-side image formation processing, first, the CPU sets to ON the flag that shows the mark Me or Mf formed with five chip marks t in the chip mark number setting area 111 of the image formation condition setting area 110 (S20). The CPU decides whether the paper onto which the read image data is to be formed is the vertically long paper or the laterally long paper, based on the direction of the mark Ma, Mb, Mc, Md, Me, or Mf that is included in the read image data (S21).

When it is decided that the paper onto which the read image data is to be formed is the vertically long paper based on the direction of the mark Ma, Mb, Mc, Md, Me, or Mf included in the read image data (Y at S21), the CPU sets to ON the flag that shows the vertical layout arranging of the chip marks t, in the layout direction setting area 112 of the image formation condition setting area 110 (S22). When it is decided that the paper onto which the read image data is to be formed is the laterally long paper (N at S21), the CPU sets to ON the flag that shows the lateral layout arranging of the chip marks t, in the layout direction setting area 112 of the image formation condition setting area 110 (S23).

The CPU decides whether the stapling has been set, by referring to the staple mode setting area 103 of the user setting area 100 (S24). When it is decided that the stapling has been set (Y at S24), the CPU rotates the image formation data to carry out the stapling at the assigned staple position within the workable range of the stapler 52, by referring to the staple mode setting area 103 of the user setting area 100 (S25). The CPU combines the image formation data and the mark Me or Mf together at every one page based on the above-described rules (S26).

When the first engine 33 is driven based on the image formation data of an odd page and the second engine 34 is driven based on the image formation data of an even page, the CPU combines the mark Me or Mf with only the image formation data of the odd page.

By driving the first and second engines 33 and 34 based on the image formation data that is combined with the mark Me or Mf, the CPU forms images on both sides of the paper (S27). The finisher unit 4 staples the paper on both sides of which the images have been formed (S28). The function of the stapler is executed this time.

As the sheets of paper fed to the finisher unit 4 are formed with the mark Me or Mf, it is easy to decide that the images have been formed by the digital copying machine 1. Based on this decision, it is possible to differentiate the image-formed paper, and facilitate the handling of the image-formed paper.

The mark Me or Mf is formed at the left lower end position on the front side of the paper when the top and bottom directions of the paper are arranged. Therefore, it is possible to prevent the mark Me or Mf from being damaged due to the stapling. Based on this arrangement, it is possible to prevent making error in recognizing the mark Me or Mf in the subsequent copying operation. Practically, the mark Me or Mf is formed at the left lower end position on the paper where there is little influence of stapling. Therefore, it is possible to effectively prevent the guide information from being damaged.

The CPU adjusts the directions of the images formed on the paper fed to the finisher unit 4 according to the staple position that the operator has assigned on the console section 61. Therefore, when the concentration mode is set to "YES" that the longitudinal direction of the paper and the top and bottom directions of the images are different corresponding to the number of images to be concentrated, the operator does not need to carry out the complex work of adjusting the document set directions by considering the staple position for each number of images to be concentrated. It is possible to obtain the stapled paper having the images formed as intended (hereinafter referred to as "finished document").

On the other hand, when it is decided that the stapling has not been set by referring to the staple mode setting area 103 of the user setting area 100 (N at S24), the CPU combines the image formation data of which top and bottom directions have been adjusted following the assigned staple position and the mark Me or Mf together, according to the setting in the staple mode setting area 103, based on the above-described rules (S29). The CPU drives the first and second engines 33 and 34 based on the combined image formation data, thereby to form the images on both sides of the paper (S30). The processing ends there. Based on the above operation, it is possible to form the marks at the left lower position on the front side of the paper in the state that the top and bottom directions of the images are arranged. Therefore, when the setting of the stapling has not been assigned, it is possible to omit the processing of rotating the image by matching the staple position.

Next, the single-side image formation processing to be executed at step S15 will be explained with reference to FIG. 12. FIG. 12 is a flowchart that schematically explains the single-side image formation processing that the CPU executes based on the control program stored in the storage. In the single-side image formation processing, the CPU decides whether the flag that shows the use of back paper or the flag that shows the use of blank paper is set to ON, by referring to the user setting area 100 (S40).

When it is decided that the flag that shows the use of back paper is ON (Y at S40), the CPU sets to ON the flag showing that the mark Mc or Md formed with four chip marks t in the chip mark number setting area 111 of the image formation condition setting area 110 (S41). Thereafter, at steps S42 to S51, the CPU executes the processing similar to that at steps S22 to S30 shown in FIG. 11.

However, at steps S48 and S51, the CPU drives the first engine 33 based on the image data, and drives the second engine 34 based on the invalid mark data. Based on this, the CPU forms the image that includes the mark Mc or Md on the front side of the paper, and forms the invalid mark as shown in FIG. 3 in superimposition with the unnecessary image on the back side of the paper. Based on the above arrangement, even when the front and back sides of the document are set wrong on the document setting table 20, the CPU forms only the necessary read image data together with the mark Mc or Md on the front side of the paper. Therefore, it is possible to restrict waste of paper, and it is possible to effectively utilize the back paper. When the back paper is used, the CPU forms the invalid mark Mz in superimposition with the invalid image. Therefore, it is possible to guide that the image is the invalid image without involving the operator's work.

On the other hand, when it is decided that the flag that shows the use of blank paper is ON (N at S40), the CPU sets to ON the flag that shows that the mark Ma or Mb formed with three chip marks t in the chip mark number setting area 111 of the image formation condition setting area 110 (S52). Thereafter, at steps S53 to S62, the CPU executes the processing similar to that at steps S22 to S30 shown in FIG. 11.

At steps S59 and S62, the CPU drives only the first engine 33 based on the image data. The second engine 34 rotates the photo conductor 36 following the feeding of the paper. At this time, the second engine 34 operates the sections such as the developing unit 39 and the cleaning unit 41 that are in contact with the photo conductor 36, following the rotation of the photo conductor 36. Based on this operation, the CPU forms the image that includes the mark Ma or Mb on the front side of the paper. As the second engine 34 no operating to form the toner image rotates in idle, no jam occurs in the paper feeding path 32. Based on the above arrangement, even when the front and back sides of the document are set wrong on the document setting table, it is possible to form only the necessary read image data together with the mark Ma or Mb on the front side of the paper. Therefore, when the image formed on one side of the paper having both blank sides is to be copied, it is possible to prevent the blank side of the paper from being copied. Therefore, it is possible to restrict waste of paper. When the setting of the stapling has not been assigned, it is possible to omit the processing of rotating the image by matching the staple position.

According to the present embodiment, when the operator sets only whether the both-side copying is required or not required, whether the concentration is required or not required, whether the stapling is required or not required, and the finishing state, it is possible to obtain the finished state as per the setting, even when the front and back sides of the document are set wrong or even when the images are set in wrong directions.

The reduction in the operator's work when the digital copying machine according to the present embodiment is used will be explained with reference to FIG. 13.

Figure 13:
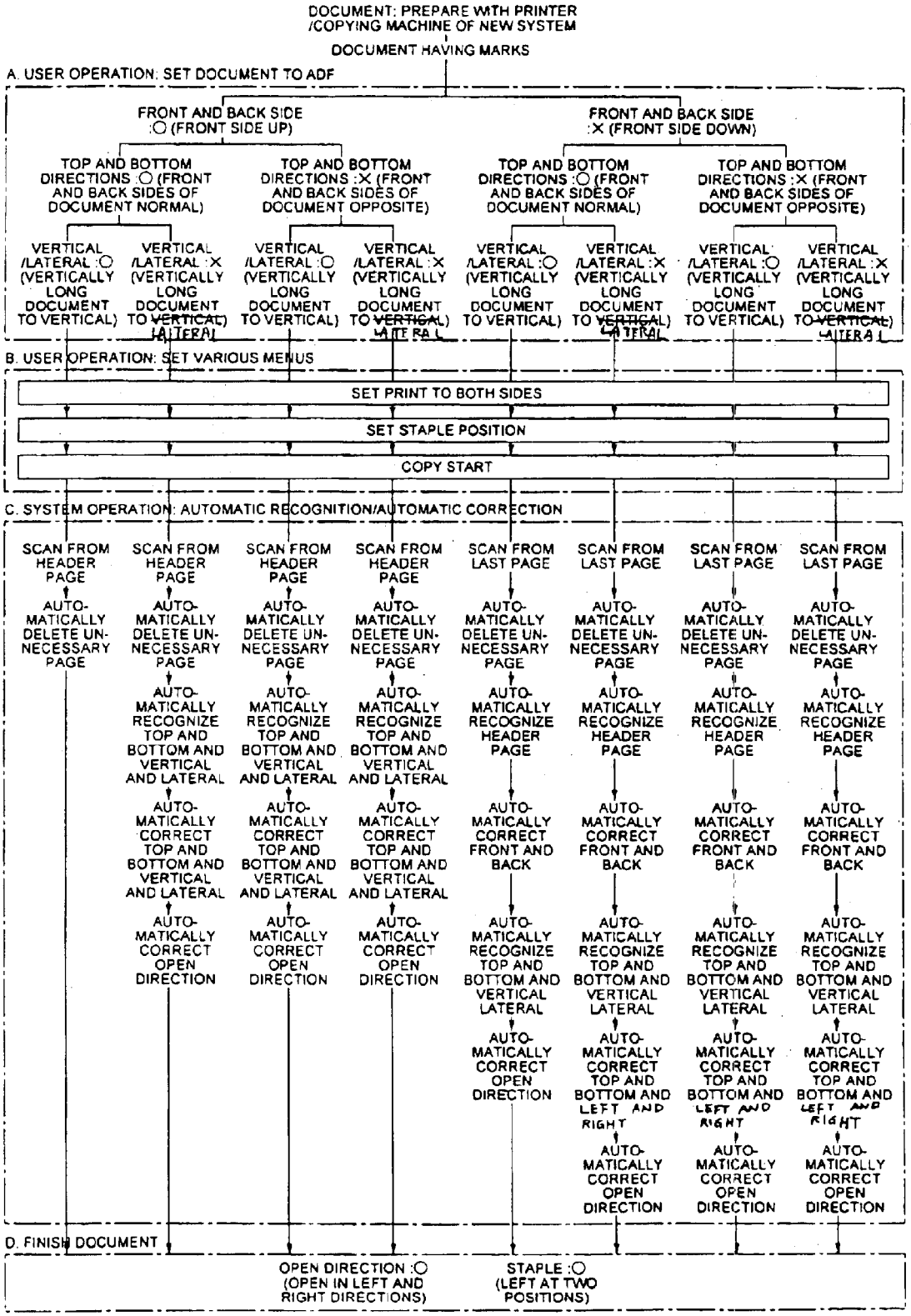
FIG. 13 is a conceptual flowchart that explains in detail the operation of a digital copying machine and the operations of an operator when the digital copying machine of the present embodiment is used to copy only necessary images onto both sides of each sheet of copying paper from vertically-long documents each having an unnecessary image on one side, and staple the copied sheets of paper at two left-end positions of the paper, thereby to prepare a set of copy that is opened in left and right directions.

FIG. 13 is a conceptual flowchart that explains in detail the operation of the digital copying machine 1 and the operation of the operator when the digital copying machine 1 is used to copy only necessary images onto both sides of each sheet of copying paper from vertically-long documents each having an unnecessary image on one side, and staple the copied sheets of paper at two left-end positions of the paper, thereby to prepare a set of copy that is opened in left and right directions.

As is clear from A in FIG. 13, when the operator sets documents without considering the directions of the documents, eight patterns from a to h can be considered as the directions of setting documents on the document setting table 20, based on the conditions of "front and back sides", "top and bottom directions", and "vertical and lateral directions". Therefore, the operator has conventionally adjusted the "front and back sides", "top and bottom directions", and "vertical and lateral directions" following the operation of the digital copying machine 1.

On the other hand, by using the digital copying machine 1 according to the present embodiment, the operator sets the "image formation mode", the "need/non-need of concentration setting", and the "need/non-need of staple setting", by bearing a desired finished document in mind (refer to B in FIG. 13). Based on the set image formation conditions, it is possible to form images by adjusting the "front and back sides", "top and bottom directions", and "vertical and lateral directions" (refer to C and D in FIG. 13).

As a result, it is possible to make the digital copying machine 1 set documents without requiring the operator to consider about the directions, and obtain the intended set of copy. Therefore, the operator is released from complex work before making copy. The operator does not need to check whether the front and back sides of the documents are in order. The operator is not required to adjust the document setting direction by matching the staple position. As a result, it is possible to simplify the operator's work.

The second embodiment of the present invention will be explained next, with reference to FIG. 14. In the second embodiment, the image formation apparatus is applied to the digital copying machine. Portions of the digital copying machine in the second embodiment that are identical with those in the first embodiment will be attached with like reference numerals, and a detailed explanation thereof will be omitted. This similarly applies to other embodiments.

Figure 14:
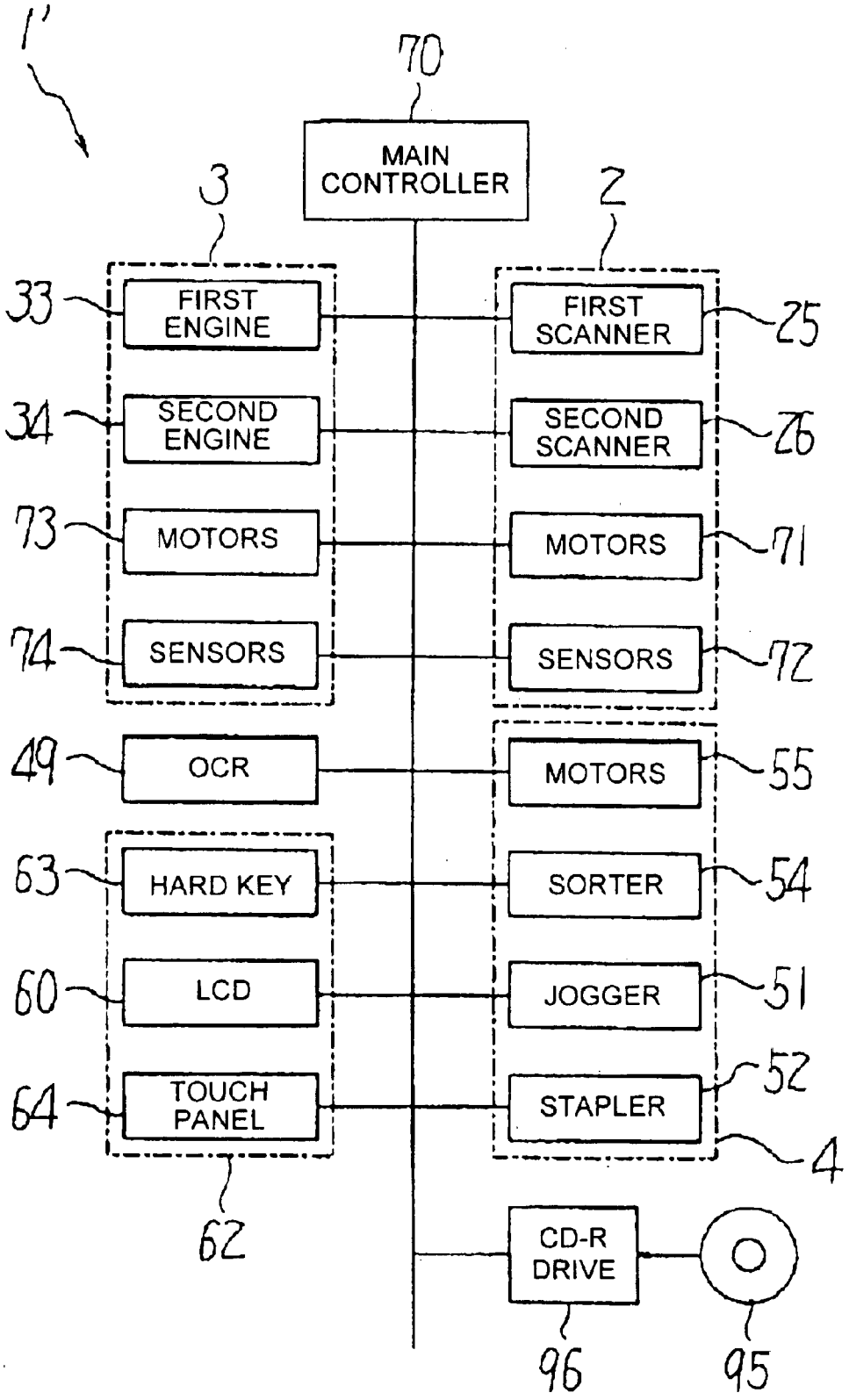
FIG. 14 is a block diagram that shows an electric connection of a control system of a digital copying machine according to the second embodiment of the present invention.

FIG. 14 is a block diagram that shows the electric connection of the control system of the digital copying machine according to the second embodiment of the present invention. A digital copying machine 1' of the present embodiment has a main controller 70 connected to a CD-ROM drive 96 that reads information stored in a CD-ROM 95 which works as a storage medium for storing a computer-readable computer program to execute a multi-functional image formation processing, via input/output units not shown.

The CD-ROM 95 is not fixedly installed on the digital copying machine 1', but is a replaceable storage medium that can be handled as a single unit, as is known in the art.

Figure 12:
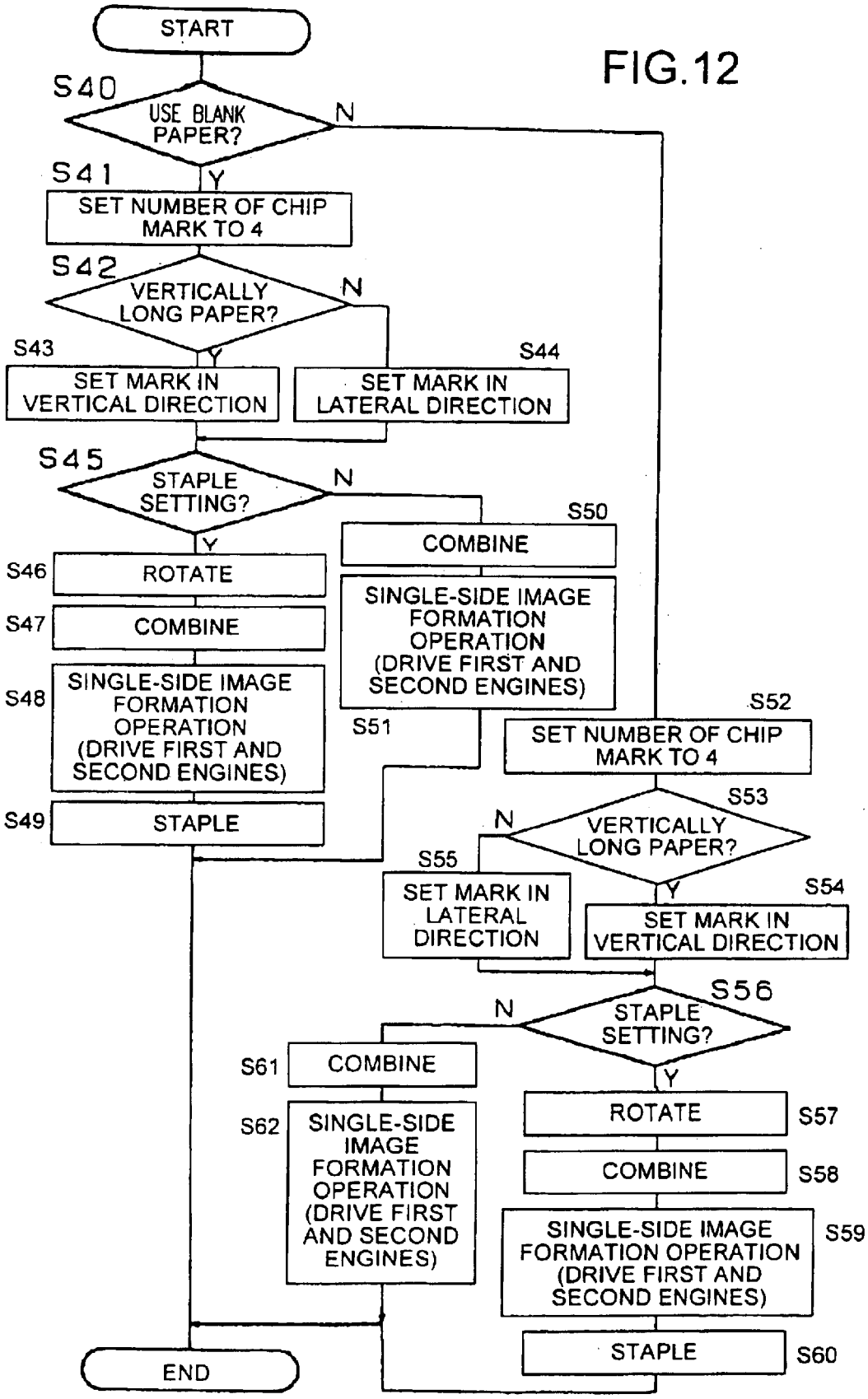
FIG. 12 is a flowchart that schematically explains a single-side image formation processing that the CPU executes based on a control program stored in the storage.

Based on the above structure, in executing the multi-functional image formation processing, the CD-ROM drive 96 is used to read the computer program stored in the CD-ROM 95, and executes the processing shown in FIG. 10 to FIG. 12 by using various work areas such as RAMs when necessary.

While the CD-ROM 95 is used as the storage medium in the present embodiment, the storage is not limited to this CD-ROM. It is also possible to use various kinds of optical disks such as a DVD-ROM, and various kinds of magnetic disks such as an optical magnetic disk, and a flexible disk. When the optical disk such as the DVD-ROM, and various kinds of magnetic disks such as the optical magnetic disk, and a flexible disk are used as the storage medium, various kinds of program reading units including a DVD-ROM drive that are adaptable to these mediums are suitably used.

In the present embodiment, while the multi-functional image formation processing is executed by reading the control program stored in the storage such as the CD-ROM 95, the execution of the processing is not limited to this method. For example, it is also possible to execute the multi-functional image formation processing based on the execution of the control program that is downloaded from a server or the like by utilizing a network such as the Internet.

Figure 15:
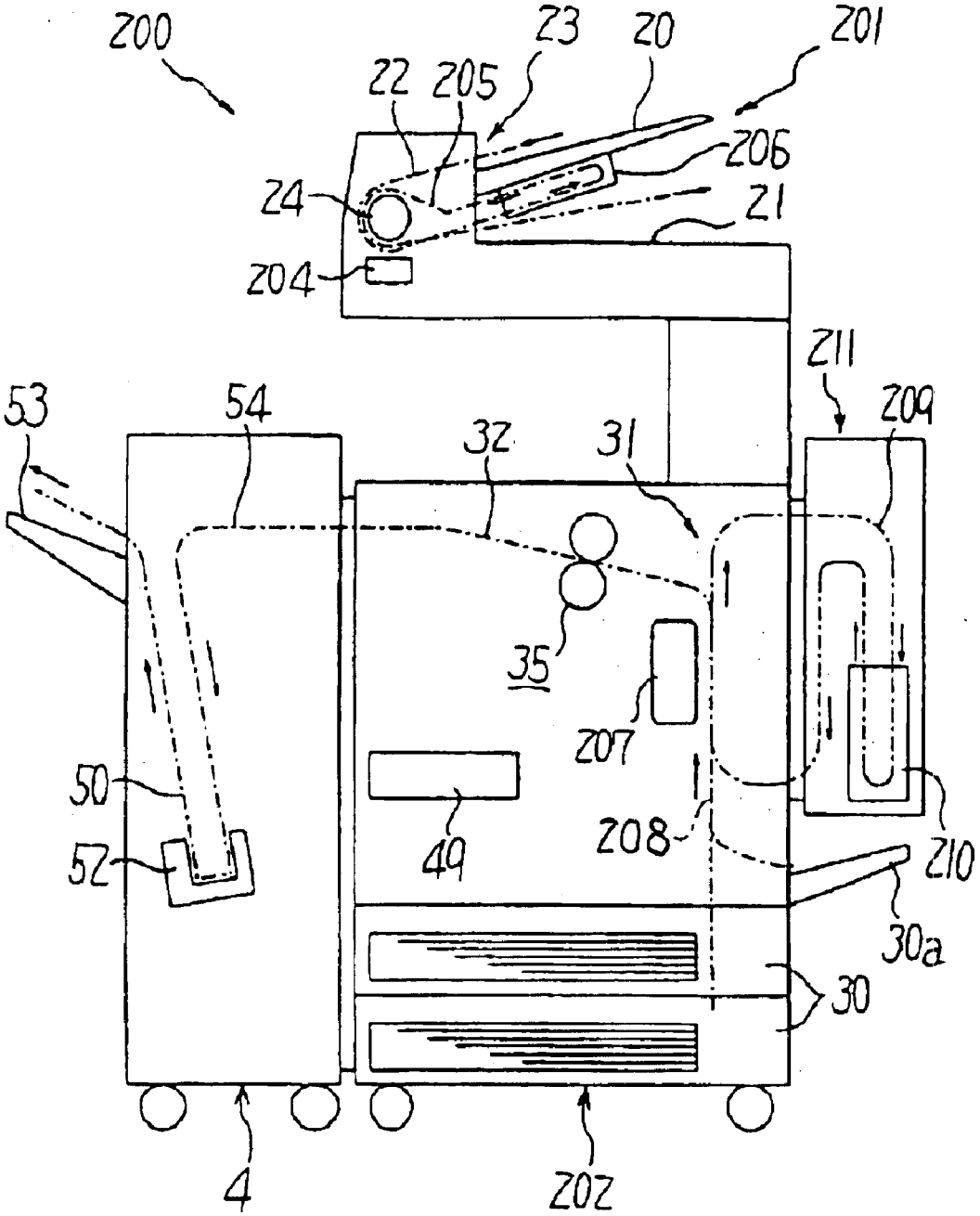
FIG. 15 is a vertical cross-sectional side view that shows a schematic structure of a digital copying machine according to the third embodiment of the present invention.

The third embodiment of the present invention will be explained next. In the third embodiment, the image formation apparatus is applied to the digital copying machine. FIG. 15 is a vertical cross-sectional side view that shows a schematic structure of the digital copying machine according to the third embodiment of the present invention. A digital copying machine 200 of the third embodiment comprises an image reading unit 201 that reads images from documents, an image formation unit 202 that forms the images based on the document image data read by the image reading unit 201, and a finisher unit 4 that staples the paper on which the images are formed by the image formation mechanism 202.

The image reading unit 201 comprises a document setting table 20, a document discharging table 21, a document feeding path 22 that communicates to between the document setting table 20 and the document discharging table 21, an ADF 23, and a scanner 204 as an image reading unit that is provided on the document feeding path 22.

The image reading unit 201 will be explained first. The image reading unit 201 has a document inversion path 205. One end of the image reading unit 201 communicates to the document feeding path 22 at the downstream of the document feeding direction from the scanner 204. The other end of the image reading unit 201 communicates to the document feeding path 22 at the upstream of the document feeding direction from the scanner 204. The document inversion path 205 has a document inverting mechanism section 206. The document inversion path 205 receives the document with the front end as a head, and the document inverting mechanism section 206 inverts the document and discharges the document with the bottom end of the document as a head. The document inverting mechanism section 206 is composed of a roller that can rotate to the forward and backward directions and provided on the document inversion path 205, and a motor that rotates the roller to the forward and backward directions. Because of the known technique, a detailed explanation of this mechanism will be omitted. The document inversion path 205 and the document inverting mechanism section 206 realize the document inversion mechanism.

The image reading unit 201 optically reads the image on the temporary front side with the scanner 204, in the process of sequentially feeding the documents with the ADF 23. The document inverting mechanism section 206 guides each document into the document inversion path 205, with the top end of the document as the head. When the whole document up to the bottom end of the document is guided to the document inversion path 205, the document inverting mechanism section 206 feeds the document toward the upstream of the document feeding direction from the scanner 204 of the document feeding path 22, with the bottom end of the document as a head. Based on this operation, the front side and the back side of the document are inverted relative to the scanner 204. When the document fed to the document feeding path 22 passes through the scanner 204 again, the scanner 204 optically reads the image from the temporary back side of the document, and discharges the document to the document discharging table 21. As a result, the single scanner 204 can read the images from both sides of the document.

The image formation unit 202 will be explained next. The image formation unit 202 comprises an engine 207 as an image formation mechanism, a fixing unit 35, and a paper feeding path 208 that continues from the paper supplying trays 30 to the finisher unit 4 via the fixing unit 35.

At the side of the image formation unit 202, there is provided a paper inverting section 211 that comprises a paper inversion path 209 and a paper inverting mechanism section 210. One end of the paper inversion path 209 communicates to the paper feeding path 208 at the downstream of the paper feeding direction from the engine 207, and the other end of the paper inversion path 209 communicates from the engine 207 to the paper feeding path 208 at the upstream of the paper feeding direction. The paper inverting mechanism section 210 discharges the paper with the bottom end of the paper as a head that has been guided into the paper inversion path 209 with the top end as a head. On the paper inversion path 209 of the paper inverting section 211, there are provided a roller that can rotate to the forward and backward directions, and a motor that rotates the roller to the forward and backward directions. Because of the known technique, a detailed explanation of this mechanism will be omitted. In the present embodiment, the paper inversion path 209 and the paper inverting mechanism section 210 realize the paper inversion mechanism.

In the image formation unit 202, the engine 207 forms an image on one side of the paper that is fed through the paper feeding path 208. The paper inverting mechanism section 210 of the paper inverting section 211 guides the paper to the document inversion path 205. The paper inverting mechanism section 210 feeds the paper guided into the paper inverting section 211 toward the upstream of the engine 207 in the paper feeding direction on the paper feeding path, with the bottom end of the paper as a head. Based on this operation, the front side and the back side of the paper are inverted, and the blank side of the paper faces the engine 207. The engine 207 forms the image of the back side onto the blank side of the paper, when the paper fed again passes through the engine 207. As a result, the single engine 207 can form the images onto both sides of the paper.

Based on the above structure, by using the single scanner 204 and the single engine 207, it is possible to obtain operation and effects similar to those of the first and second embodiments. Therefore, as compared with the digital copying machine that has a plurality of the scanners 204 and a plurality of the engines 207, it is possible to lower the manufacturing cost of the digital copying machine 200, although the operation speed is lowered.

Figure 16:
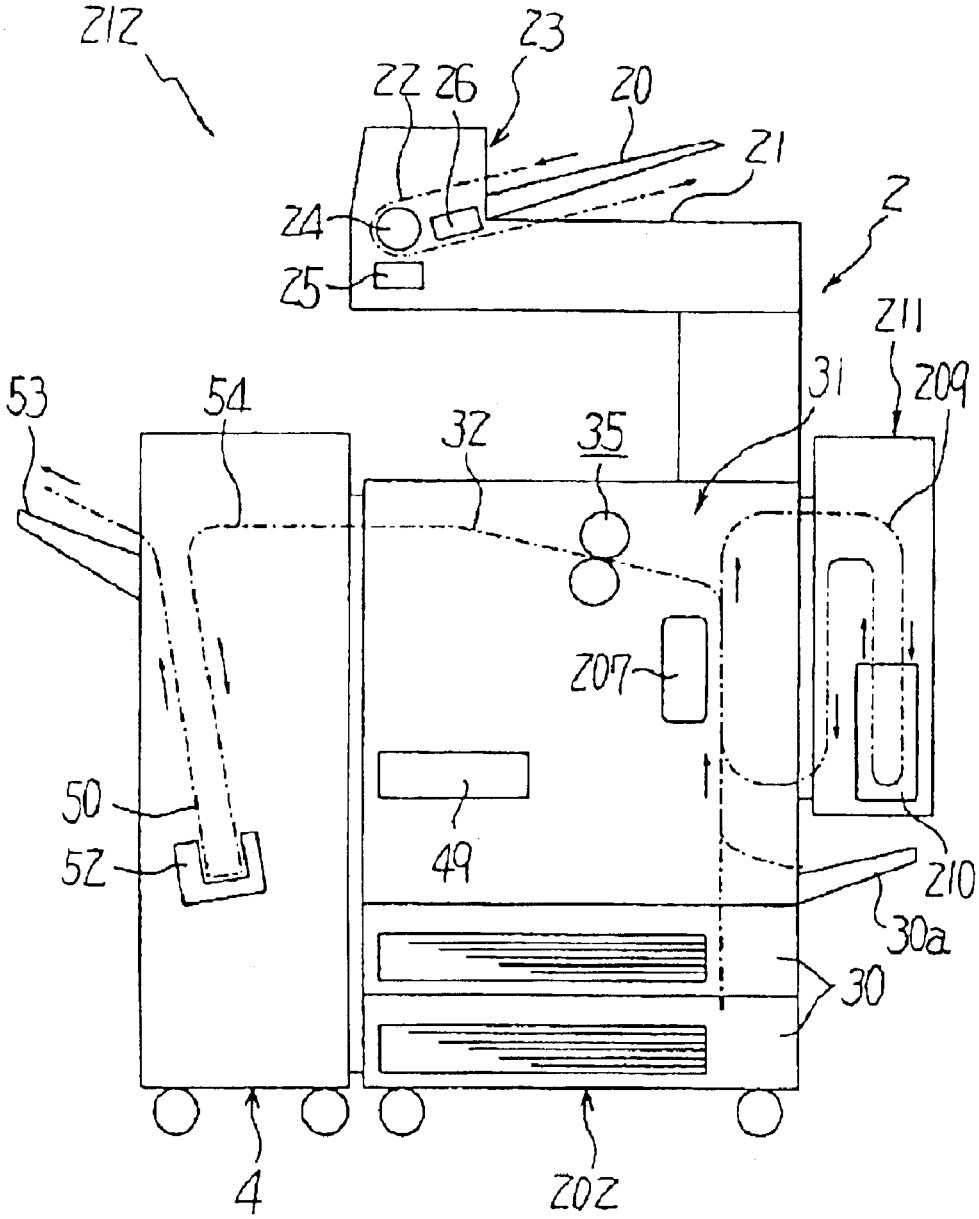
FIG. 16 is a vertical cross-sectional side view that shows a schematic structure of a digital copying machine according to another embodiment of the present invention.
Figure 17:
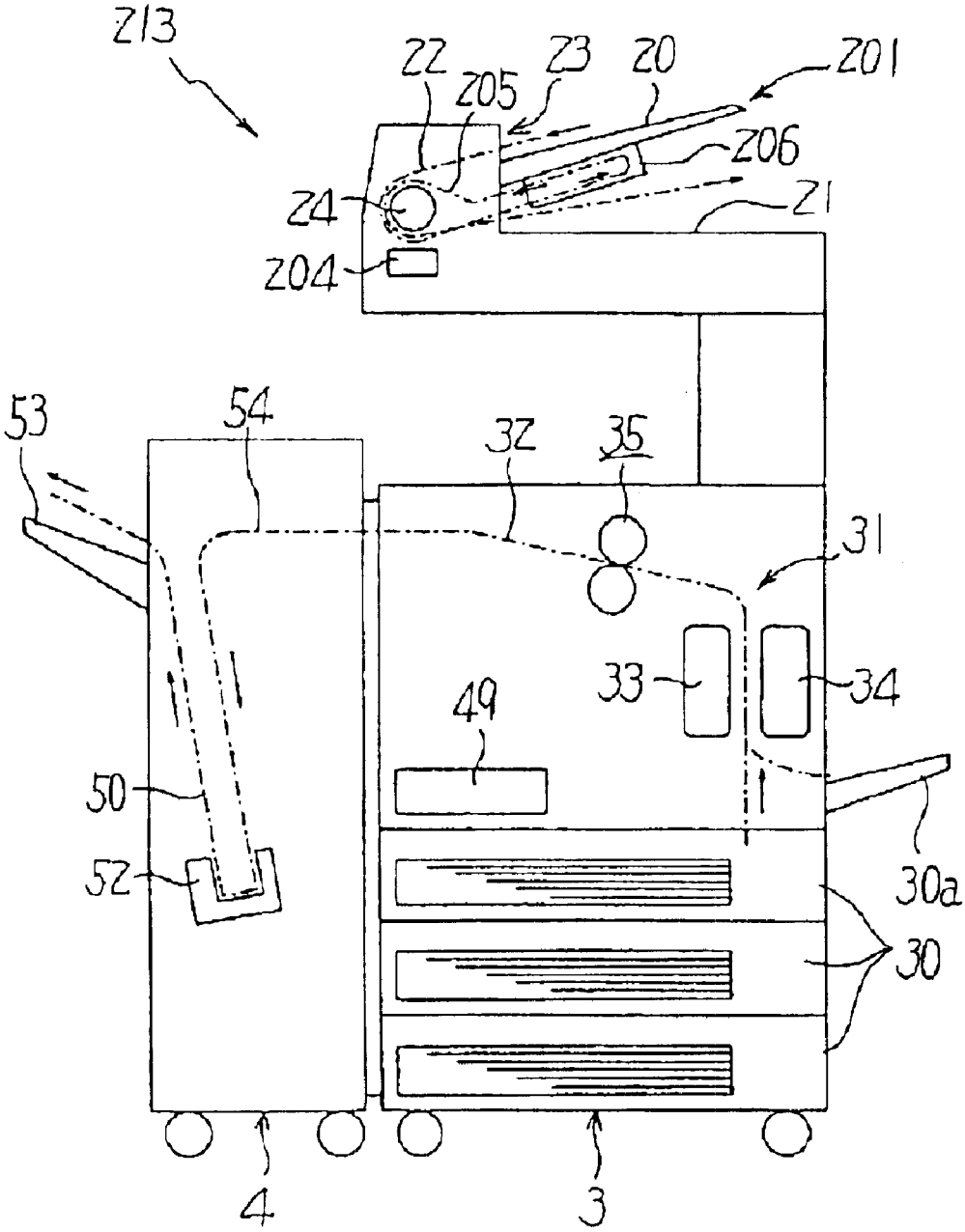
FIG. 17 is a vertical cross-sectional side view that shows a schematic structure of a digital copying machine according to still another embodiment of the present invention.

Further, a digital copying machine 212 that comprises the image reading unit 2, an image formation unit 202, and the finisher unit 4 as shown in FIG. 16, and a digital copying machine 213 that comprises an image reading unit 201, the image formation unit 3, and the finisher unit 4 as shown in FIG. 17, can also obtain operation and effects similar to those of the first and second embodiments and the present embodiment. As explained above, when one of the image reading unit 201 and the image formation unit 202 is changed to the single scanner 204 or the single engine 207, it becomes possible to achieve both a high processing speed and a large cost reduction of the digital copying machine 212 or 213.

The fourth embodiment of the present invention will be explained next with reference to FIG. 18 and FIG. 19. In the present embodiment, the application of the image formation apparatus to the image formation system will be explained, where the scanner and the printer are connected to each other via the host unit of a personal computer or the like.

Figure 18:
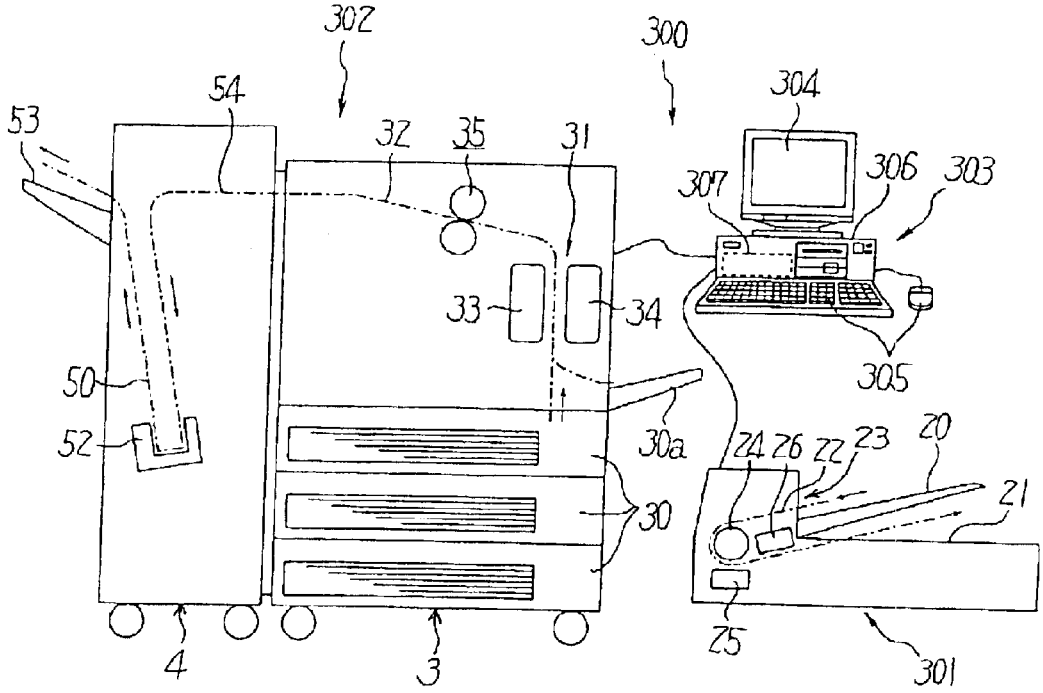
FIG. 18 is a schematic view of an image formation system according to the fourth embodiment of the present invention.

FIG. 18 is a schematic view of the image formation system according to the fourth embodiment of the present invention. An image processing system 300 of the present embodiment is structured by connecting a scanner 301 that reads the images on both sides of a document, and a printer 302 that comprises the finisher unit 4, to each other via the host unit of a personal computer 303. The scanner 301 and the printer 302 have structures similar to those of the image reading unit 2 and the image formation unit 3 respectively, and therefore, a detailed explanation of these units will be omitted.

The personal computer 303 of the present embodiment has a structure and functions similar to those of a general-purpose personal computer, and therefore, a detailed explanation of the personal computer will be omitted. The personal computer 303 is connected with a display section 304 consisting of a cathode-ray tube (CRT) or an LCD, and an input section 305 including a keyboard and a mouse. The personal computer 303 comprises a control section 306 incorporating a microcomputer that controls the driving of various sections including the display section 304 and the input section 305 of the personal computer. The control section 306 has a storage 307 such as a hard disc drive (HDD) that is installed with the optical character reader (OCR) software.

The OCR software installed on the storage 307 is a program for realizing the function of recognizing the necessary side of the document, by collating the document image read by the scanner with a standard pattern stored in advance. Because of the known technique, a detailed explanation of the OCR software will be omitted.

The OCR software is not limited to that installed on the storage 307 like the HDD. It is also possible to store the OCR software in various kinds of optical disks such as a CD-ROM, a DVD-ROM, and various kinds of magnetic disks such as an optical magnetic disk, and a flexible disk, or various kinds of storage mediums such as a semiconductor memory. In this case, the optical disks such as the CD-ROM, the DVD-ROM, and the magnetic disks such as the optical magnetic disk, and the flexible disk, are not fixedly installed on the personal computer. These mediums can be used as a single unit or can be replaced. Various kinds of program reading units such as a CD-ROM drive, a DVD-ROM drive, or a flexible disk drive that are adaptable to these mediums are used to read the program. Based on this, it is possible to carry out the collation.

On the storage 307, there is installed driver software for setting the image formation mode of the printer 302, need/non-need of stapling, and a staple position. Based on this arrangement, the personal computer of the image processing system 300 can set the image formation mode of the printer 302, need/non-need of stapling, and a staple position.

Figure 19:
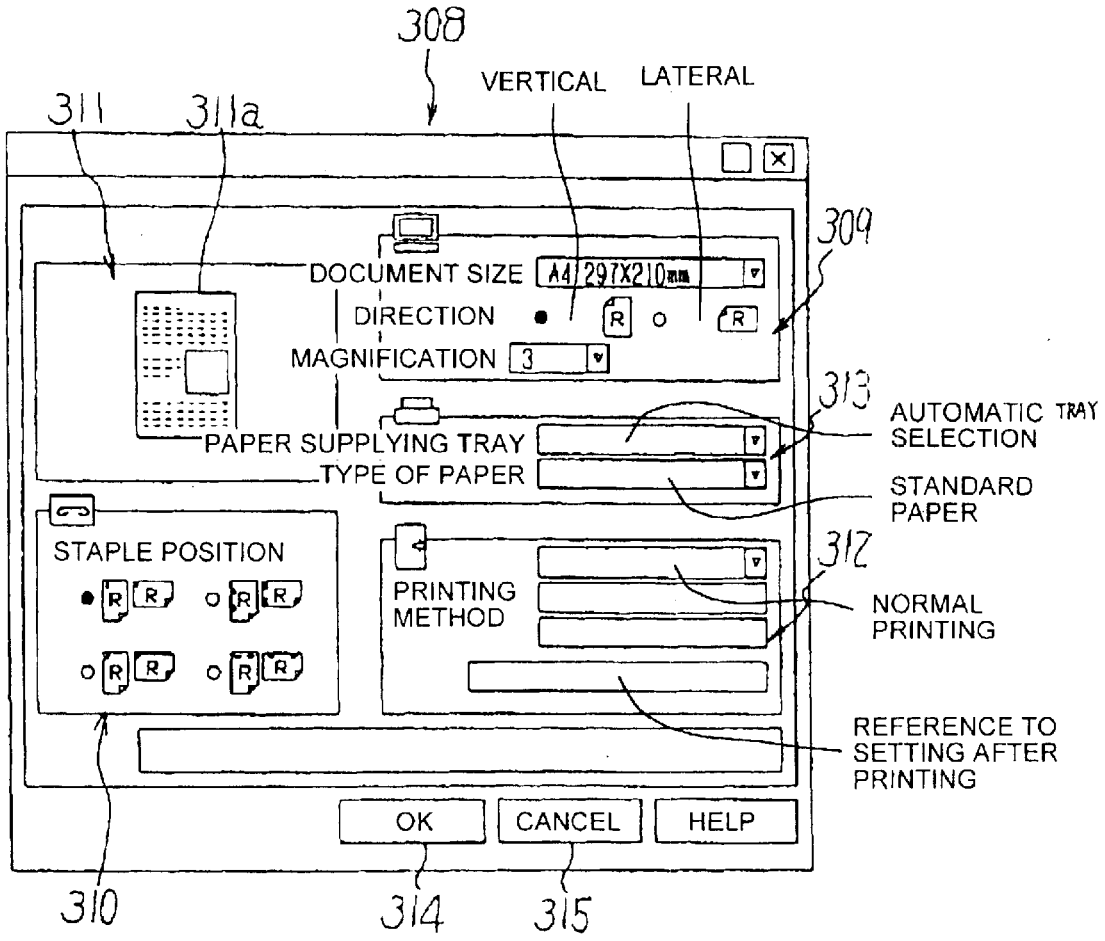
FIG. 19 is a front view of an operation mode setting screen that is displayed on a display section of a personal computer.

FIG. 19 is a front view of the operation mode setting screen that is displayed on the display section 304 of the personal computer 303. An operation mode setting screen 308 shown in FIG. 19 is displayed on the display section 304, based on a predetermined input operation at the input section 305 of the personal computer 303 installed with the driver software. An operation mode setting screen 308 comprises a paper setting section 309 that sets a paper size of the document to be printed, a direction, and a number of sheets onto which the print is made, a staple position setting section 310 that sets a staple position, and an image display section 311 on which an image 311*a* that shows a finishing state is displayed based on the setting of the various display areas. The image 311*a* that is displayed on the image display section 311 displays a finishing state corresponding to a changed setting, each time when the setting of the paper setting section 309, and the staple position setting section 310 on the operation mode setting screen 308 is changed. Based on this arrangement, it is possible to confirm the finishing state before the print is actually carried out. Therefore, it is possible to restrict the occurrence of a setting error more effectively.

The operation mode setting screen 308 further comprises an image formation mode setting section 312 that sets the single-side/both-side image formation mode and the concentration mode, and a paper supplying tray setting section 313 that sets one paper supplying tray 30 and a type of paper.

The personal computer executes the multi-functional image formation processing based on the conditions set in the operation mode setting screen 308, when a "ready key" 314 is touched in the state that the operation mode setting screen 308 is displayed. When a "cancel key" 315 displayed on the operation mode setting screen 308 is touched, it is possible to interrupt the setting.

Figure 20:
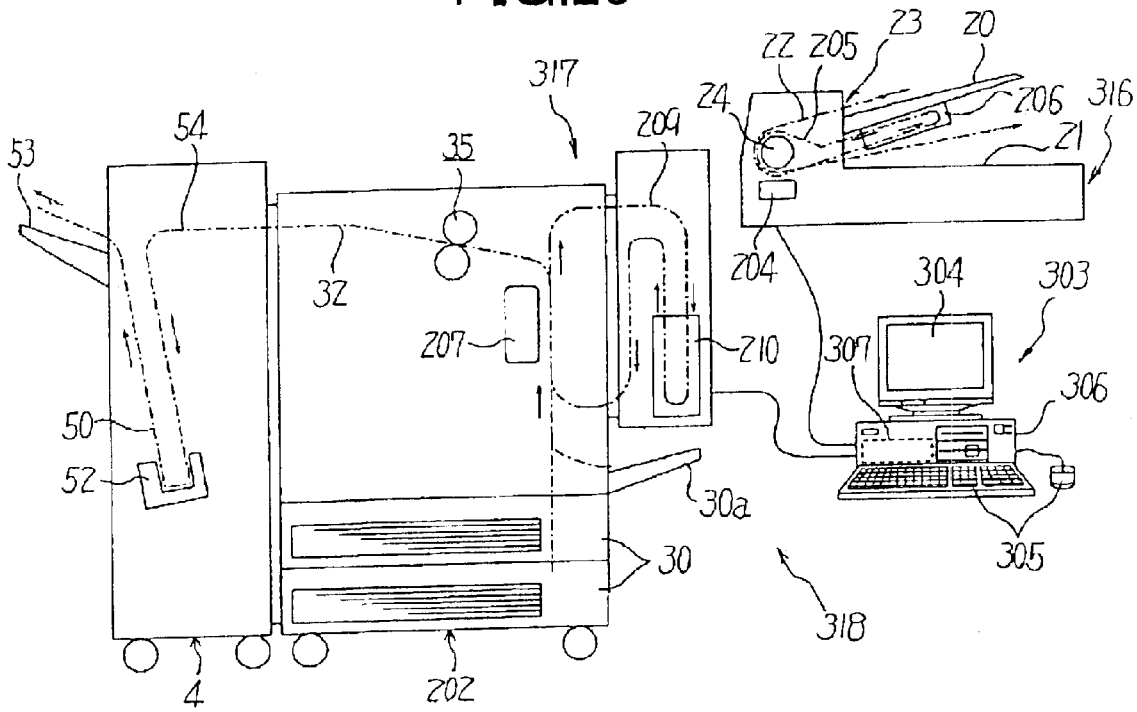
FIG. 20 is a schematic view of an image formation system according to another embodiment of the present invention.

In the present embodiment, the image processing system 300 is structured by having the scanner 301 and printer 302 connected to each other via the personal computer 303. However, the structure is not limited to this. For example, as shown in FIG. 20, it is also possible to structure the image processing system 318 by connecting a scanner 316 (refer to the image reading unit 201 in FIG. 15) having mechanisms 205 and 206 for inverting the document, and a printer 317 (refer to the image formation unit 202 in FIG. 15) having a paper inverting section 211, to each other, via a personal computer 303.

In the present embodiment, the image processing system 300 is structured by having the scanner 301 and printer 302 directly connected to each other using wires via the personal computer 303. However, the connection is not limited to this method. It is also possible to connect these units indirectly via other personal computer in an LAN. The connection is not limited to the cable connection, but may be a wireless connection based on infrared transmission or the like.

The fifth embodiment of the present invention will be explained next with reference to FIG. 21 to FIG. 27. The digital copying machine according to the fifth embodiment has a structure similar to that of the digital copying machine 1 in the first embodiment. The fifth embodiment is different from the first embodiment in that the digital copying machine of the fifth embodiment has a function of reducing the load of the operator at the time of copying a document on which an image has been formed by an image formation apparatus other than the digital copying machine of the present embodiment.

Figure 21:
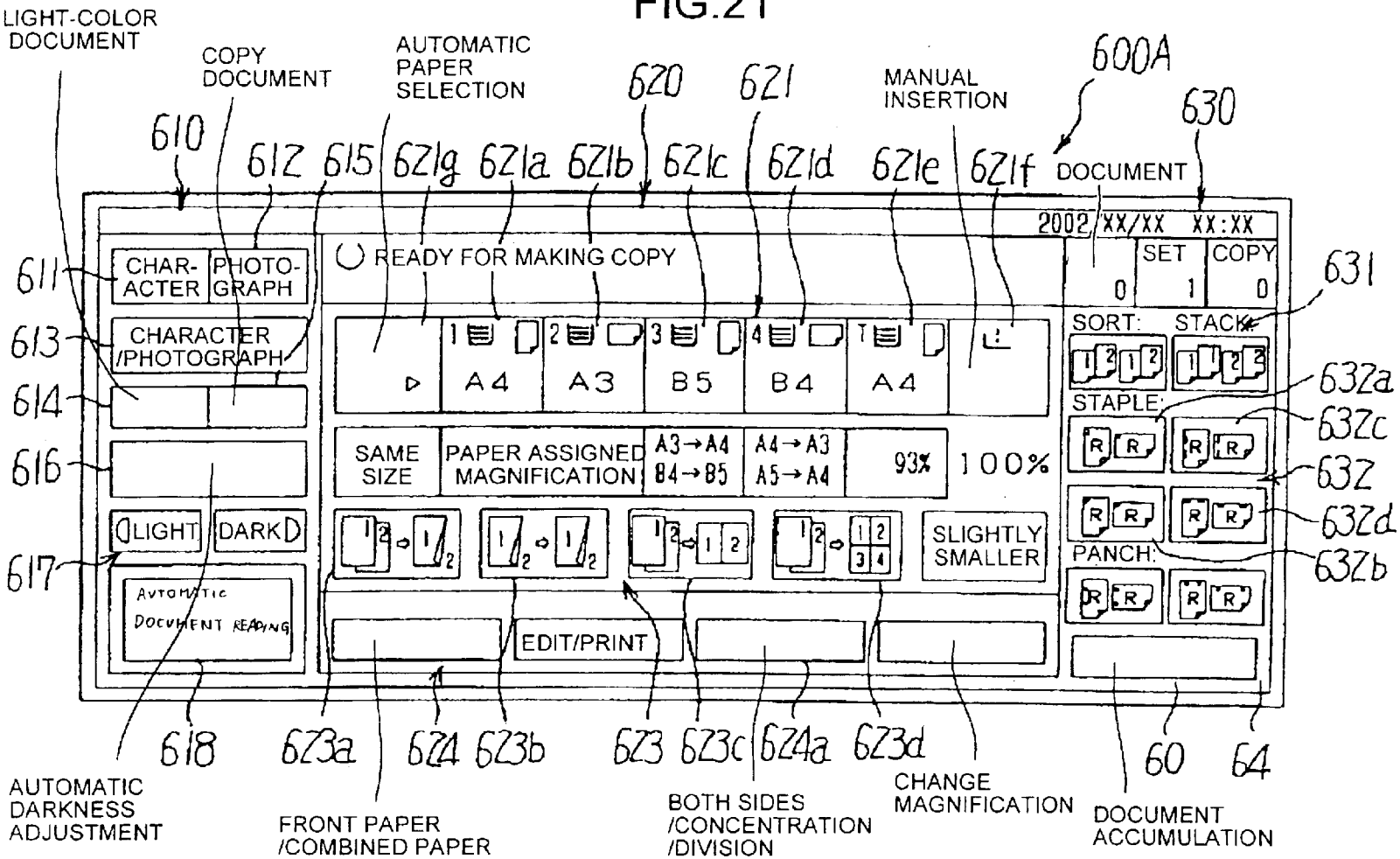
FIG. 21 shows a queue screen that is displayed on an LCD according to the fifth embodiment of the present invention.

FIG. 21 shows a queue screen 600A that is displayed on the LCD 60 according to the fifth embodiment of the present invention. The queue screen 600A displays the illustrations displayed in the reading condition setting section 610, the image formation condition setting section 620, and the finisher condition setting section 630 shown in FIG. 5, and an illustration that guides a position of a "supporting system start key" 618 that declares the start of a supporting system for executing an image automatic recognition processing to be described later.

Figure 22:
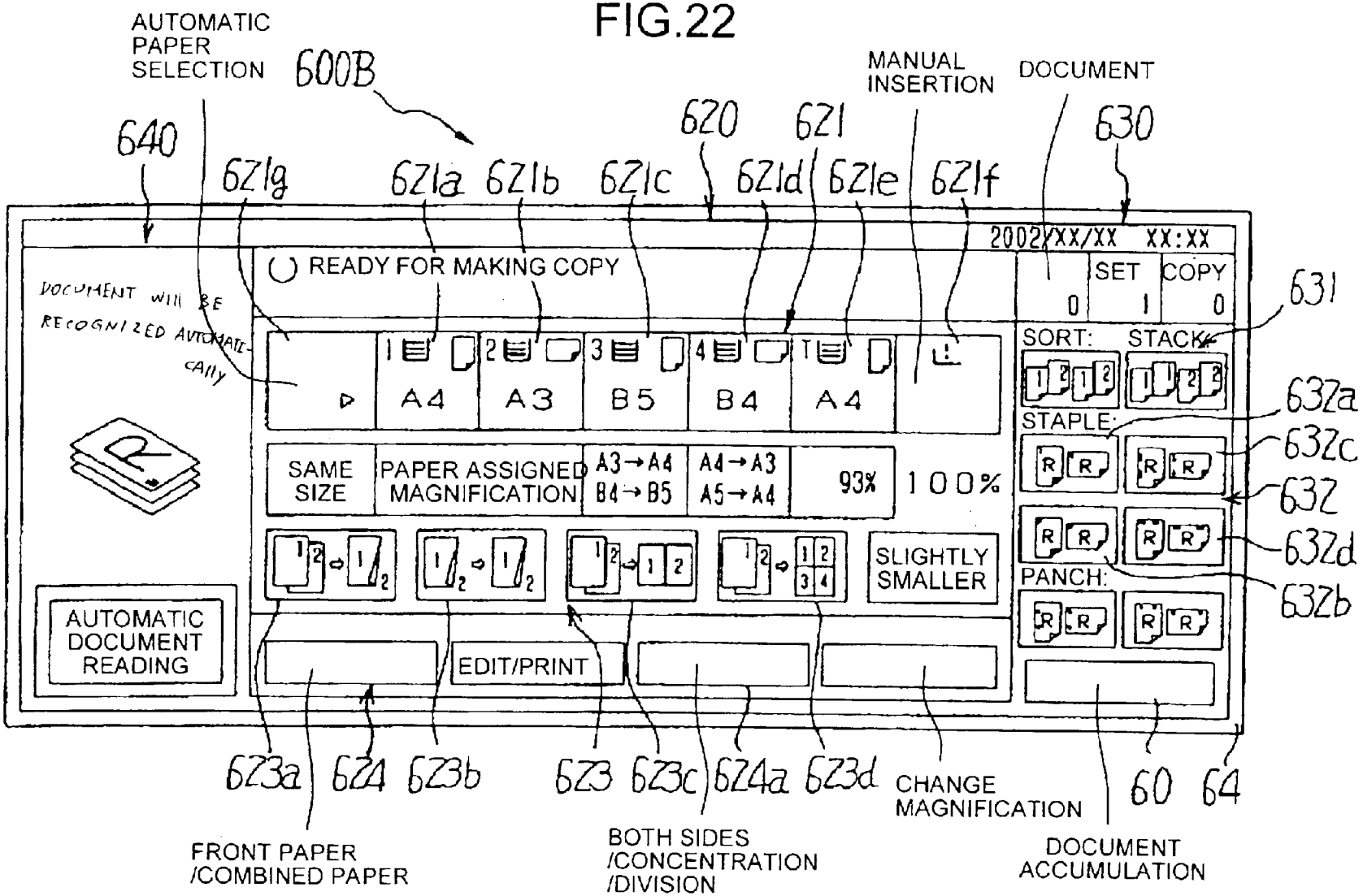
FIG. 22 shows a setting screen that is displayed when a "supporting system start key" is touched.

FIG. 22 shows supporting system start screen 600B that is displayed when the "supporting system start key" 618 shown in FIG. 21 is touched. When the "supporting system start key" 618 is touched, the supporting system is started. The display of the reading condition setting section 610 is changed over to a supporting system start display 640 that includes a message showing a starting of the supporting system like "The document will be automatically recognized", on the supporting system start screen 600B. The supporting system start display 640 works during the period while the supporting system is ON.

The image automatic recognition processing of the digital copying machine 1 will be explained with reference to FIG. 23 to FIG. 26. FIG. 23 is a flowchart that schematically explains the image automatic recognition processing that the CPU executes based on the control program stored on the storage when the supporting system is ON. In the present embodiment, the CPU executes the image automatic recognition processing based on the condition that the supporting system is ON after the "supporting system start key" 618 displayed on the LCD 60 has been touched. The processing at steps S80 to S83 is similar to the processing carried out at steps S1 to S4 shown in FIG. 10.

Figure 24:
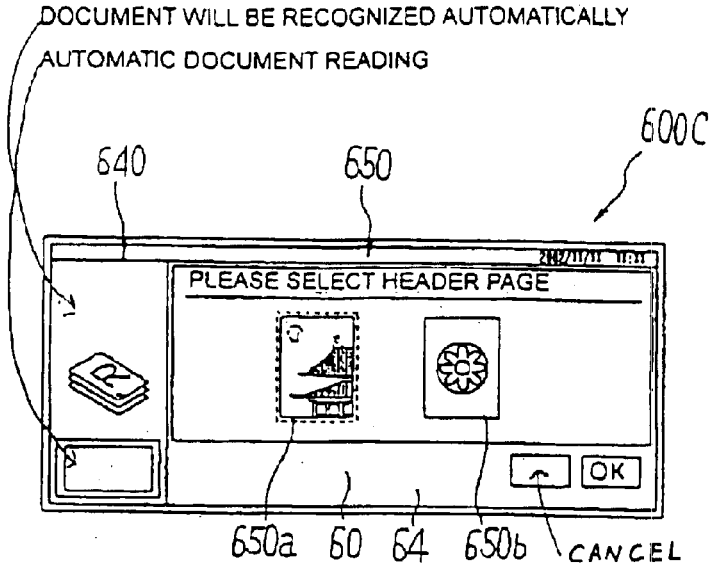
FIG. 24 is a front view of a header selection screen.

When it is decided that the read image data does not include any one of the marks Ma, Mb, Mc, Md, Me, and Mf (N at S4), the CPU displays a header selection screen 600C as shown in FIG. 24 (S84).

As shown in FIG. 24, on the header selection screen 600C, there are displayed the supporting system start display 640, and an image display section 650 that displays an image 650*a* read first by the first scanner 25, and an image 650*b* read last by the second scanner 26. The CPU makes these displays at the portions where the image formation condition setting section 620 and the finisher condition setting section 630 are displayed on the queue screen 600A.

The operator touches one of the images 650*a* and 650*b*, thereby to assign the header image. FIG. 24 shows a state that the operator selects the image 650*a* as the header image.

Figure 25:
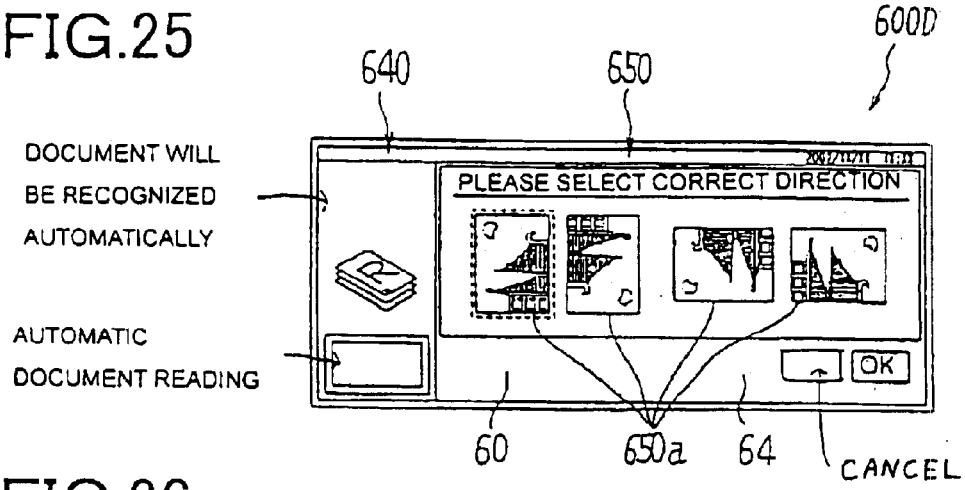
FIG. 25 is a front view of a top and bottom selection screen.

When it is decided that the image 650*a* that is first read by the first scanner 25 has been selected based on the operator's touch operation (Y at S85), the CPU makes display of a top and bottom selection screen 600D as shown in FIG. 25 (S86).

On the top and bottom selection screen 600D, the image display section 650 displays the image 650*a* selected on the header selection screen 600C, in four patterns of different directions, as shown in FIG. 25.

The operator touches any one of the four patterns of the image 650*a* displayed, thereby to assign the image that correctly displays the top and bottom directions. FIG. 25 shows a state that the operator selects the image 650*a* displayed on the left end on the image display section 650 as the image that correctly displays the top and bottom directions.

The CPU waits for the operation until when the operators selects by touching the image 650*a* that correctly displays the top and bottom directions (N at S87). When it is decided that the operator selected the image 650*a* that correctly displays the top and bottom directions (N at S87), the CPU adjusts the top and bottom directions of other read image data by matching the top and bottom directions of the selected image 650*a* (S88).

On the other hand, when it is decided that the operator selected the image 650*b* that is last read by the second scanner 26 (N at S85), the CPU changes the order of the read image data (S89), and the process proceeds to step S86.

Figure 26:
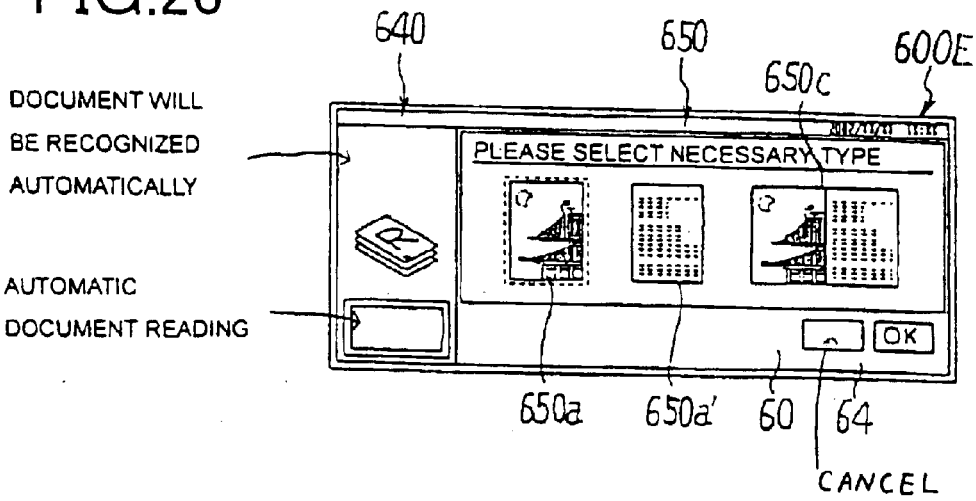
FIG. 26 is a front view of a both-side necessary/unnecessary selection screen.

The CPU decides whether the read document is a both-side printed document, based on the image data read by the first and second scanners 25 and 26 (S90). When it is decided that the read document is the both-side printed document (Y at S90), the CPU makes displays of a both-side need/non-need selection screen 600E as shown in FIG. 26 (S91). The CPU executes the unclear image display unit and the unclear image display function at steps S84, S86, S88, and S91.

The both-side need/non-need selection screen 600E displays images 650*a*, 650*a*', and 650*c* that show the front side, the back side, and both sides respectively of the document assigned as the header image.

The operator touches any one of the images 650*a*, 650*a*', and 650*c* that show the front side, the back side, and both sides respectively, thereby to select whether the necessary image(s) of the document is the image on only the front side, the image on only the back side, or the images on both sides. FIG. 26 shows a state that the image 650*a* on only the front side is selected. The CPU executes the need/non-need assigning unit and the need/non-need assigning function at steps S85, S87, S90, and S92.

The CPU waits for the operation until when the image on only the front side, the image on only the back side, or the images on both sides have been selected based on the operator's touch operation (N at S92). When it is decided that the image on only the front side, the image on only the back side, or the images on both sides have been selected based on the operator's touch operation (Y at S92), the CPU adjusts other read image data according to the conditions (S93). In the present embodiment, it is assumed that only the read image data on the front side is left, and the read image data on the back side is deleted.

On the other hand, when it is decided that the document is not the both-side printed document (N at S90), the process proceeds to step S94.

The processing at steps S94 to S99 is similar to that carried out at steps S10 to S15 shown in FIG. 10. After finishing the processing at these steps, the image automatic recognition processing ends.

When it is decided that any one of the marks Ma, Mb, Mc, Md, Me, and Mf has been recognized in the read image data (Y at S83), the CPU decides whether the recognized mark is the mark Ma or Mb that is formed with three chip marks t (S100).

When it is decided that the recognized mark is the mark Ma or Mb that is formed with three chip marks t (Y at S100), the CPU decides whether the read document is a both-side printed document based on the image data read by the first and second scanners 25 and 26 (S101). When it is decided that the read document is the both-side printed document (Y at S101), the process proceeds to step S84.

On the other hand, when it is decided that the recognized mark is not the mark Ma or Mb that is formed with three chip marks t (N at S100), the CPU decides whether the recognized mark is the mark Mc or Md that is formed with four chip marks t (S102).

When it is decided that the recognized mark is the mark Mc or Md that is formed with four chip marks t (Y at S102), the CPU decides that the document is the single-side printed document, and deletes unnecessary read image data (S103). Then, the process proceeds to step S104.

When it is decided that the document is not the both-side printed document (N at S101), or when the recognized mark is not the mark Mc or Md that is formed with four chip marks t (that is, the document is the both-side printed document) (N at S102), the CPU adjusts the top and bottom directions of the read image data according to the recognized mark Ma, Mb, Mc, Md, Me, or Mf (S104). Then, the process proceeds to step S94.

Based on the above operation, when the read image such as a photograph that has no characters includes guide information, or when it is not possible to recognize guide information from the read image because of unclear print, it is possible to copy the document without the influence of the presence or absence of guide information or the state of guide information on the document. The CPU realizes the assignment image formation function this case.

The reduction in the operator's work when the digital copying machine according to the present embodiment is used will be explained with reference to FIG. 27.

Figure 27:
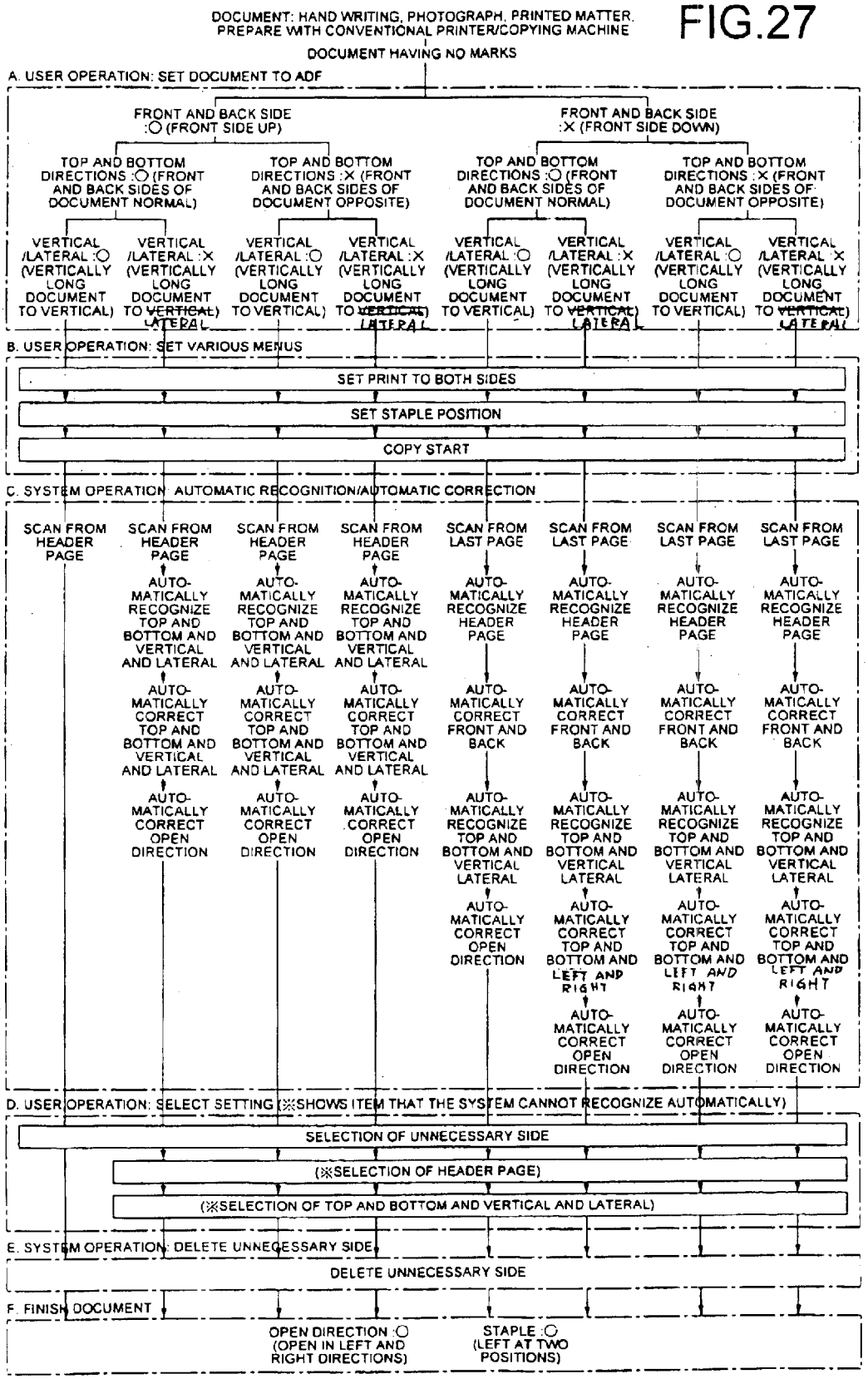
FIG. 27 is a conceptual flowchart that explains in detail the operation of a digital copying machine and the operation of an operator when an image formation apparatus other than the digital copying machine of the present embodiment is used to copy only necessary images onto both sides of each sheet of copying paper from vertically-long documents each having an unnecessary image on one side, and staple the copied sheets of paper at two left-end positions of the paper, thereby to prepare a set of copy that is opened in left and right directions.
Figure 28A:
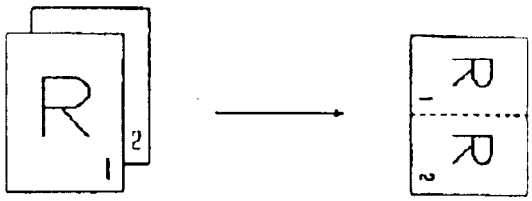
FIG. 28A and FIG. 28B are explanatory views that show a relationship of top and bottom relationship between images on documents and paper on which the images are formed, in the concentration formation of document images.
Figure 28B:
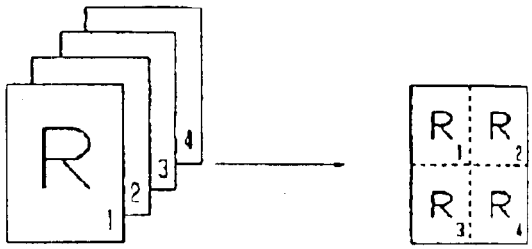

FIG. 27 is a conceptual flowchart that explains in detail the operation of the digital copying machine and the operator's work when the image formation apparatus other than the digital copying machine of the present embodiment is used to copy only necessary images onto both sides of each sheet of copying paper from vertically-long documents each having an unnecessary image on one side, and staple the copied sheets of paper at two left-end positions of the paper, thereby to prepare a set of copy that is opened in left and right directions.

As is clear from A in FIG. 27, when the operator sets documents without considering the directions of the documents, eight patterns from a to h can be considered as the directions of setting documents on the document setting table 20, based on the conditions of "front and back sides", "top and bottom directions", and "vertical and lateral directions". As is clear from C in FIG. 27, when the digital copying machine 1 of the present embodiment is used, the digital copying machine 1 can form images by adjusting the "front and back sides", "top and bottom directions", and "vertical and lateral directions", following the set direction of the documents and the set image formation conditions (refer to FIG. 27).

When the "front and back sides" and the "top and bottom directions" of the read document are not clear, the CPU makes display of the header selection screen 600C. Therefore, when the unnecessary image is deleted based on the operator's touch operation, it is possible to copy only the necessary image from the document, even when the document is not attached with the mark Ma, Mb, Mc, Md, Me, or Mf.

Therefore, even when the document is not attached with the mark Ma, Mb, Mc, Md, Me, or Mf, following the operation of the digital copying machine 1, it is possible to obtain a desired set of copy based on the intended image formation conditions, without involving the operator's adjustment work of the "front and back sides", "top and bottom directions", and "vertical and lateral directions". Consequently, the operator can be released from the complex work of checking the front and back sides of the documents and adjusting the document setting direction by matching the staple position, prior to the copying. As a result, it is possible to simplify the operator's work.

According to a first aspect of the present invention, there is provided an image formation method for making an image formation apparatus form on the paper an image and guide information that shows that the image has been formed by the image formation apparatus. Based on the guide information formed on the paper, it is possible to decide that the image has been formed based on the image formation method of the present invention. Therefore, it is possible to facilitate the handling of the image-formed paper, by differentiating the paper.

According to a second aspect of the invention, there is provided the image formation method of the first aspect, wherein out of read images, only a read image that includes guide information is formed on the paper together with the guide information. Therefore, it is possible to form only the necessary image on the paper, and it is possible to prevent waste of paper. As a result, it is possible to restrict cost increase due to waste of paper, and restrict waste of resources.

According to a third aspect of the invention, there is provided the image formation method of the second aspect, wherein it is possible to form only the necessary image on the paper, even when images are read from both sides of the document. For example, even when the front and back sides of the document are set wrong, it is possible to form only the necessary image on the paper. Therefore, it is possible to prevent waste of paper. Consequently, it is possible to omit the operator's work of arranging the front and back sides of documents at the time of setting the documents. This facilitates the work, and improves efficiency. At the same time, it is possible to restrict cost increase due to waste of paper, and restrict waste of resources.

According to a fourth aspect of the invention, there is provided an image formation apparatus that forms an image and guide information at the same time. Therefore, it is possible to decide that the image formation apparatus has formed the image based on the guide information. As a result, it is possible to differentiate the image-formed paper, thereby to facilitate the handling of the image-formed paper.

According to a fifth aspect of the invention, there is provided the image formation apparatus of the fourth aspect, wherein the image formation apparatus deices the top and bottom directions of the image-formed paper, based on the position of the guide information on the paper. Therefore, it is possible to improve the handling of the image-formed paper.

According to a sixth aspect of the invention, there is provided the image formation apparatus of the fourth or the fifth aspect, wherein at the time of copying the image from the document, the image formation apparatus forms only a valid image after excluding the guide information from the read image. Therefore, when the document formed with the guide information is copied, it is always possible to provide the same image, regardless of the number of times of making copy. Based on this, it is possible to differentiate the image-formed paper at the time of copying the document. This makes it possible to prevent the operator from being confused to take a copied sheet of paper as the original document. It is possible to differentiate the image-formed paper, without generating any inconvenience due to the formation of the guide information. As a result, it is possible to improve the handling of the paper.

According to a seventh aspect of the invention, there is provided the image formation apparatus of the sixth aspect, wherein the image formation apparatus can read all the images even when the front and back sides of the document are set wrong. Therefore, it is possible to avoid the operator's work of setting each document as a single-side printed document or a both-side printed document, or arranging the front and back sides of the documents at the time of setting the documents. This facilitates the work, and improves efficiency. At the same time, it is possible to restrict cost increase due to waste of paper, and restrict waste of resources.

According to an eighth aspect of the invention, there is provided the image formation apparatus of the seventh aspect, wherein the image formation apparatus can read images from both sides of the document based on a single image reading mechanism. Therefore, it is possible to simplify the structure.

According to a ninth aspect of the invention, there is provided the image formation apparatus of the seventh aspect, wherein the image formation apparatus can read images from both sides of the document based on first and second reading mechanisms. Therefore, it is possible to improve the efficiency of reading images on the document.

According to a tenth aspect of the invention, there is provided the image formation apparatus of any one of the sixth to the ninth aspects, wherein when it is decided that there is guide information, the image formation apparatus forms a valid image on the paper by adjusting the top and bottom directions of the read image based on position information of the guide information included in the read image so that sheets of paper formed with images are stapled at a set staple position. Therefore, it is possible to staple the image-formed paper at a suitable position based on the top and bottom directions of the paper, without involving the conventional troublesome and complex manual work of the operator such as the adjustment of set directions of the documents and setting of the staple position by considering the top and bottom directions of the image-formed paper. This can reduce the load of the operator without depending on the ability of the operator who needs to learn the complex operation and build up experience. At the same time, it is possible to effectively utilize the functions of the image formation apparatus.

According to an eleventh aspect of the invention, there is provided the image-formation apparatus of the tenth aspect, wherein under the setting of the concentration mode, the image formation apparatus can form valid images on the paper by adjusting directions, based on a set staple position and a set number of images to be concentrated. Therefore, under the setting of the concentration mode, it is possible to obtain the effects of the image formation apparatus of the tenth aspect. As a result, it is possible to effectively utilize the function of the image formation apparatus.

According to a twelfth aspect of the invention, there is provided the image formation apparatus of the tenth or the eleventh aspect, wherein the image formation apparatus forms guide information at a position different from the set staple position. Therefore, it is possible to prevent damaging of the guide information due to the stapling. Based on this, it is possible to prevent making error in recognizing the guide information in the subsequent copying operation.

According to a thirteenth aspect of the invention, there is provided the image formation apparatus of any one of the fourth to the twelfth aspects, wherein the image formation apparatus forms guide information at the left lower end of the paper. Therefore, it is possible to form the guide information at a position that has practically no influence of stapling or punching. As a result, it is possible to effectively prevent the damaging of the guide information.

According to a fourteenth aspect of the invention, there is provided the image formation apparatus of any one of the fourth to the thirteenth aspects, wherein the image formation apparatus forms guide information on one side of the paper. Therefore, even when valid images are formed on both sides of the paper, it is possible to obtain the valid image from the image read from one side of the paper. As a result, it is possible to simplify the analysis of the read images.

According to a fifteenth aspect of the invention, there is provided the image formation apparatus of the fourteenth aspect, wherein an image formation mechanism forms an image on one side of the paper, and a paper inverting mechanism inverts the paper and feeds the paper to the image formation mechanism again. As the single image formation mechanism can form images on both sides of the paper, it is possible to simplify the structure of the image formation apparatus.

According to a sixteenth aspect of the invention, there is provided the image formation apparatus of the fourteenth aspect, wherein a first image formation mechanism forms an image on one side of the paper, and a second image formation mechanism forms an image on the other side of the paper. Therefore, it is possible to improve the efficiency of forming images on both sides of the paper.

According to a seventeenth aspect of the invention, there is provided the image formation apparatus of any one of the fourteenth, the fifteenth, and the sixteenth aspects, wherein the image formation apparatus selectively forms first or second guide information on one side of the paper. Therefore, it is possible to guide the state of both sides of the image-formed paper, based on one guide information. As a result, it is possible to facilitate the handling of the image-formed paper, by differentiating the image-formed paper more effectively.

According to an eighteenth aspect of the invention, there is provided the image formation apparatus of the fourteenth aspect, wherein the image formation apparatus selectively forms on one side of the paper guide information corresponding to the type of paper used under the setting of the singe-side image formation mode. Therefore, under the setting of the singe-side image formation mode, it is possible to guide the state of the back side of the image-formed paper, based on the single guide information. Based on this, it is possible to differentiate the image-formed paper more effectively. This makes it possible to prevent the operator from being confused to take a copied sheet of paper as the original document. As a result, it is possible to improve the handling of the paper.

According to a nineteenth aspect of the invention, there is provided the image formation apparatus of the eighteenth aspect, wherein the image formation apparatus selects a valid image from among read images, corresponding to the kind of analyzed guide information. Therefore, it is possible to avoid the operator's work of setting each document as a single-side printed document or a both-side printed document, or arranging the front and back sides of the documents at the time of setting the documents, without depending on the type of document about whether the valid image is on one side or on both sides of the document. This facilitates the work, and improves efficiency. At the same time, it is possible to restrict cost increase due to waste of paper, and restrict waste of resources. As a result, it is possible to reduce the load of the operator.

According to a twentieth aspect of the invention, there is provided the image formation apparatus of the eighteenth or the nineteenth aspect, wherein when the back paper mode has been set, the image formation apparatus forms invalid information in superimposition with an invalid image on the paper. As it is possible to decide the invalid image on the paper more securely, it becomes possible to prevent making error in recognizing the necessary side of the image-formed paper more effectively.

According to a twenty-first aspect of the invention, there is provided the image formation apparatus of any one of the sixth to the twentieth aspects, wherein the image formation apparatus displays on a display section a read image that does not include guide information out of read images, and forms on the paper the read image assigned as necessary from the read images that are displayed on the display section. With this arrangement, it is possible to copy the image read from the document even when the document is not formed with guide information. Therefore, it is possible to obtain the effects of any one of the fifth or the nineteenth aspect, without depending on the presence or absence of guide information.

According to a twenty-second aspect of the invention, there is provided a computer program of making the guide information formed on the paper that shows that the image formation apparatus formed the image, in executing the image formation operation. Therefore, it is possible to facilitate the handling of the image-formed paper, by differentiating the paper.

According to a twenty-third aspect of the invention, there is provided the computer program of the twenty-second aspect, wherein when the read image has the guide information, a valid image excluding the guide information included in this read image is formed on the paper. Therefore, when the document formed with the guide information is copied, it is always possible to provide the same image, regardless of the number of times of making copy.

According to a twenty-fourth aspect of the invention, there is provided the computer program of the twenty-third aspect, wherein an image is formed on the paper by adjusting directions based on a set staple position and the top and bottom directions of the recognized read image. Therefore, it is possible to staple the image-formed paper at a suitable position based on the top and bottom directions of the paper, without involving the operator's conventional troublesome and complex manual work of adjusting set directions of the documents and setting the staple position by considering the directions of the image-formed paper. This can reduce the load of the operator without depending on the ability of the operator who needs to learn the complex operation and build up experience. At the same time, it is possible to effectively utilize the functions of an image formation apparatus.

According to a twenty-fifth aspect of the invention, there is provided the computer program of the twenty-fourth aspect, wherein under the setting of the concentration mode, images are formed on the paper by adjusting directions based on a staple position set by the stapler and a number of images to be concentrated. Therefore, under the setting of the concentration mode, it is possible to obtain the effects of the computer program of the twenty-fourth aspect.

According to a twenty-sixth aspect of the invention, there is provided the computer program of any one of the twenty-second to the twenty-sixth aspects, wherein under the setting of the single-side image formation mode, first guide information that shows that a valid image is formed on one side of the paper is formed on the same side of the valid image, and under the setting of the both-side image formation mode, second guide information that shows that valid images are formed on both sides of the paper is formed on one side of the paper. With this arrangement, it is possible to decide the valid image based on the image read from one side of the image-formed paper. Therefore, it is possible to simplify the analysis of the read images.

According to a twenty-seventh aspect of the invention, there is provided the computer program of the twenty-sixth aspect, wherein under the setting of the single-side image formation mode and the back paper mode, third guide information that shows that an invalid image is formed is formed on the same side as the valid image. With this arrangement, it is possible to guide the state of the back side of the image-formed paper, based on the single guide information. This makes it possible to differentiate the image-formed paper more effectively. For example, it becomes possible to prevent the operator from being confused to take a copied sheet of paper as the original document. As a result, it is possible to improve the handling of the paper.

According to a twenty-eighth aspect of the invention, there is provided the computer program of the twenty-seventh aspect, wherein when first guide information is included, a read image that includes this first guide information is formed on the paper, when second guide information is included, read images on both sides of a document are formed on the paper, and when third guide information is included, a read image that includes this third guide information is formed on the paper out of the images read from both sides of the document. Therefore, it is possible to avoid the operator's work of setting each document as a single-side printed document or a both-side printed document, or arranging the front and back sides of the documents at the time of setting the documents, without depending on the type of document about whether the valid image is on one side or on both sides of the document. This facilitates the work, and improves efficiency. At the same time, it is possible to restrict cost increase due to waste of paper, and restrict waste of resources. As a result, it is possible to reduce the load of the operator.

According to a twenty-ninth aspect of the invention, there is provided the computer program of any one of the twenty-third to the twenty-eighth aspects, wherein out of read images that do not include guide information, a read image that is displayed on a display section and is assigned as necessary is formed on the paper. Based on this arrangement, it becomes possible to copy the image read from a document that is not formed with guide information. As a result, it is possible to obtain the effects of any one of the twenty-third to the twenty-eighth aspects, without depending on the presence or absence of guide information.

According to a thirtieth aspect of the invention, there is provided a storage medium that stores a computer program. Therefore, when the computer program stored in the storage medium is installed on the computer, it is possible to obtain the effects that are similar to those obtained when the program in any one of the twenty-second to the twenty-ninth aspects is executed.

The present document incorporates by reference the entire contents of Japanese priority document, 2002-032503 filed in Japan on Feb. 8, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation method, comprising:

forming on a paper an image of a document with an image formation unit; and printing on the paper a guide information, which represents a layout of the document, with the image formation unit, wherein the guide information comprises at least one mark having an orientation related to an orientation of the paper.

2. The image formation method according to claim 1, further comprising:

making an image reading unit read the image formed on the paper and containing the guide information; and making the image formation unit form the image and the guide information on a different paper.

3. The image formation method according to claim 2, wherein the image reading unit is able to read a first surface and a second surface of the document.

4. An image formation apparatus comprising:

an image formation unit that forms on a paper an image read from a document; and a guide information printing unit that prints on the paper a guide information, which represents a layout of the document, wherein the guide information comprises at least one mark having an orientation related to an orientation of the paper.

5. The image formation apparatus according to claim 4, wherein the guide information printing unit forms the guide information at a predetermined position on the paper.

6. The image formation apparatus according to claim 4, wherein the guide information printing unit forms the guide information at a lower left corner of the paper.

7. The image formation apparatus according to claim 4, wherein the image formation unit is able to form valid images on a first surface and a second surface of the paper, and the guide information printing unit prints the guide information on any one of the first surface and the second surface of the paper.

8. The image formation apparatus according to claim 7, in which the image formation unit comprises:

an image formation mechanism that forms an image on a first surface of the paper having the first surface and a second surface; and a paper inverting mechanism that inverts the paper and feeds the inverted paper to the image formation mechanism.

9. The image formation apparatus according to claim 7, in which the image formation unit comprises:

a first image formation mechanism that forms a first image on the first surface of paper; and a second image formation mechanism that forms a second image on the second surface of the paper.

10. The image formation apparatus according to claim 7, further comprising:

an image formation mode setting unit that selectively sets one of a single-side image formation mode in which the image formation unit forms an image on only the first surface of the paper, and a both-side image formation mode in which the image formation unit forms images on both the first surface and the second surface of the paper, wherein when the image formation mode setting unit has set the single-side image formation mode, the guide information printing unit forms on the first surface of the paper a first guide information that shows that a valid image is formed on the first surface, and when the image formation mode setting unit has set the both-side image formation mode, the guide information printing unit forms on any one of the first surface and the second surface of the paper a second guide information that shows that valid images are formed on the first surface and second surface of the paper.

11. An image formation apparatus, comprising:

an image formation unit that forms on a paper an image read from a document;

a guide information printing unit that forms guide information at a predetermined position on the paper and prints on the paper a guide information, which represents a layout of the document;

an image reading unit that reads an image from a document; and a guide presence/absence deciding unit that decides presence or absence of the guide information at the predetermined position, by analyzing the image read by the image reading unit, wherein when the guide presence/absence deciding unit decides that the guide information is present, the image formation unit forms only the image read by the image reading unit on a different paper and does not print the guide information on the different paper.

12. The image formation apparatus according to claim 11, wherein the image reading unit is able to read a first surface and a second surface of the document.

13. The image formation apparatus according to claim 12, wherein the image reading unit comprises:

an image reading mechanism that reads an image from the first surface of the document; and a document inverting mechanism that inverts the document, and feeds the inverted document to the image reading mechanism.

14. The image formation apparatus according to claim 12, in which the image reading unit comprises:

a first reading mechanism that reads a first image from the first surface of the document; and a second reading mechanism that reads a second image from the second surface of the document.

15. The image formation apparatus according to claim 11, further comprising:

a stapler that staples sheets of paper on which the image formation unit has formed images;

a staple position setting unit that sets a staple position of the stapler, based on the sheets of paper of which top and bottom directions of the images have been adjusted; and a direction recognizing unit that recognizes the top and bottom directions of the images read by the image reading unit, based on the position information of the guide information included in the read images, when the guide presence/absence deciding unit has decided that the guide information is present, wherein the image formation unit forms on the paper, valid images of which directions are adjusted based on the top and bottom directions of the read images recognized by the direction recognizing unit so that the sheets of paper are stapled at the staple position set by the staple position setting unit.

16. The image formation apparatus according to claim 15, further comprising:

a concentration mode setting unit that selectively sets one of a non-concentration mode of forming one image on each of two surfaces of each of a plurality of the papers, and a concentration mode of forming a plurality of images on each of the two surfaces of the papers, wherein when the concentration mode setting unit has set the concentration mode, the image formation unit forms valid images on the paper after adjusting directions of the images based on the staple position set by the staple position setting unit and the number of images to be concentrated.

17. The image formation apparatus according to claim 15, wherein the image formation unit forms the guide information at a position different from the staple position set by the staple setting unit.

18. The image formation apparatus according to claim 11, further comprising:

an unclear image display unit that displays the image read by the image reading unit on a display section, when the guide presence/absence deciding unit has decided that there does not exist the guide information; and a need/non-need assigning unit that assigns necessity or non-necessity of the read image that the unclear image display unit has displayed on the display section, wherein the image formation unit forms the read image that the need/non-need assigning unit has assigned as the necessary image.

19. The An image formation apparatus, comprising:

an image formation unit that forms on a paper an image read from a document;

a guide information printing unit that prints on the paper a guide information, which represents a layout of the document, wherein the image formation unit is able to form valid images on a first surface and a second surface of the paper, and the guide information printing unit prints the guide information on any one of the first surface and the second surface of the paper;

an image formation mode setting unit that selectively sets one of a single-side image formation mode in which the image formation unit forms an image on only the first surface of the paper, and a both-side image formation mode in which the image formation unit forms images on both the first surface and the second surface of the paper, wherein when the image formation mode setting unit has set the single-side image formation mode, the guide information printing unit forms on the first surface of the paper a first guide information that shows that a valid image is formed on the first surface, and when the image formation mode setting unit has set the both-side image formation mode, the guide information printing unit forms on any one of the first surface and the second surface of the paper a second guide information that shows that valid images are formed on the first surface and second surface of the paper; and a paper mode setting unit that selectively sets one of a normal single-side image formation mode of forming a valid image on the first surface of the paper having both the first surface and the second surface blank, and a back paper mode of forming a valid image on the second surface of the paper that has an invalid image formed on the first surface, when the image formation mode setting unit has set the single-side image formation mode, wherein when the paper mode setting unit has set the back paper mode, the guide information printing unit forms on the second surface of the paper a third guide information that shows that an invalid image has been formed on the first surface of the paper.

20. The image formation apparatus according to claim 19, further comprising:

a guide presence/absence deciding unit that decides presence or absence of the guide information at the predetermined position;

a guide type deciding unit that analyzes the guide information, and decides whether the guide information is any one of the first guide information, the second guide information, and the third guide information, when the guide presence/absence deciding unit has decided that the guide information exists, wherein when the guide presence/absence deciding unit has decided that the guide information is the first guide information, the image formation unit obtains a valid image from the read image in which the guide presence/absence deciding unit has decided that the guide information exists, when the guide presence/absence deciding unit has decided that the guide information is the second guide information, the image formation unit obtains valid images from the images read from the first surface and the second surface of the document, and when the guide presence/absence deciding unit has decided that the guide information is the third guide information, the image formation unit obtains a valid image from the read image that includes the third guide information out of the images read from the first surface and the second surface of the document, and forms the obtained valid image on the paper.

21. The image formation apparatus according to claim 19, wherein when the paper mode setting unit has set the back paper mode, the image formation unit forms an invalid information that shows the image is an invalid image, in superimposition with the invalid image on the paper.

22. An image formation apparatus, comprising:

an image formation unit that forms on a paper an image read from a document;

a guide information printing unit that prints on the paper a guide information, which represents a layout of the document, wherein the guide information printing unit forms the guide information at a lower left corner of the paper;

a guide presence/absence deciding unit that decides presence or absence of the guide information at the predetermined position;

an image reading unit that reads an image from a document;

an unclear image display unit that displays the image read by the image reading unit on a display section, when the guide presence/absence deciding unit has decided that there does not exist the guide information; and a need/non-need assigning unit that assigns necessity or non-necessity of the read image that the unclear image display unit has displayed on the display section, wherein the image formation unit forms the read image that the need/non-need assigning unit has assigned as the necessary image.

23. An image formation apparatus, comprising:

an image formation unit that forms on a paper an image read from a document;

a guide information printing unit that prints on the paper a guide information, which represents a layout of the document, wherein the image formation unit is able to form valid images on a first surface and a second surface of the paper, and the guide information printing unit prints the guide information on any one of the first surface and the second surface of the paper;

a guide presence/absence deciding unit that decides presence or absence of the guide information at the predetermined position;

an image reading unit that reads an image from a document;

an unclear image display unit that displays the image read by the image reading unit on a display section, when the guide presence/absence deciding unit has decided that there does not exist the guide information; and a need/non-need assigning unit that assigns necessity or non-necessity of the read image that the unclear image display unit has displayed on the display section, wherein the image formation unit forms the read image that the need/non-need assigning unit has assigned as the necessary image.

24. A computer program that makes a computer execute:

forming on a paper an image of a document with an image formation unit; and printing on the paper a guide information, which represents a layout of the document, with the image formation unit, wherein the guide information comprises at least one mark having an orientation related to an orientation of the paper.

25. The computer program according to claim 24, that makes the computer execute:

setting one of a single-side image formation mode of forming an image on a first surface of the paper, and a two-side image formation mode of forming images on the first surface and a second surface of the paper;

when the single-side image formation mode is set, then forming a first guide information that shows that a valid image is formed on the first surface of the paper a first guide information that shows that a valid image is formed on the first surface; and when the both-side image formation mode is set, then forming on any one of the first surface and the second surface of the paper a second guide information that shows that valid images are formed on the first surface and second surface of the paper.

26. A computer program that makes the computer execute:

forming on a paper an image of a document with an image formation unit;

printing on the paper a guide information, which represents a layout of the document, with the image formation unit;

deciding whether a guide information exists in an image read by an image reading unit from a surface of a document; and when it is decided that the guide information exists in the read image, forming only the image read by the image reading unit on a different paper and not printing the guide information on the different paper.

27. The computer program according to claim 26, that makes the computer execute:

setting a staple position that indicates where a stapler should staple a plurality of the different paper;

recognizing the top and bottom directions of the image read by the image reading unit, based on the position of the guide information in the read image; and forming on the different paper an image of which direction is adjusted based on the set staple position and the recognized top and bottom directions of the read image.

28. The computer program according to claim 27, that makes the computer execute:

setting one of a non-concentration mode of forming one image on each of two surfaces of each of a plurality of the papers, and a concentration mode of forming a plurality of images on each of the two surfaces of the papers; and when the concentration mode is set, then forming on the paper an image of which direction is adjusted based on the staple position and a number of images to be formed in the concentration mode.

29. The computer program according to claim 26, that makes the computer execute:

displaying the image read by the image reading unit and that does not include the guide information;

assigning whether the image displayed is necessary or not necessary; and forming on the paper a read image that is assigned as necessary.

30. A computer program that makes the computer execute:

forming on a paper an image of a document with an image formation unit;

printing on the paper a guide information, which represents a layout of the document, with the image formation unit;

setting one of a single-side image formation mode of forming an image on a first surface of the paper, and a two-side image formation mode of forming images on the first surface and a second surface of the paper;

when the single-side image formation mode is set, then forming a first guide information that shows that a valid image is formed on the first surface of the paper a first guide information that shows that a valid image is formed on the first surface;

when the both-side image formation mode is set, then forming on any one of the first surface and the second surface of the paper a second guide information that shows that valid images are formed on the first surface and second surface of the paper;

when the single-side image formation mode is set, setting one of a normal single-side image formation mode of forming a valid image on the first surface of the paper having both the first surface and the second surface blank, and a back paper mode of forming a valid image on the second surface of the paper that has an invalid image formed on the first surface; and when the back paper mode is set, then forming on the second surface of the paper a third guide information that shows that an invalid image has been formed on the first surface of the paper.

31. The computer program according to claim 30, that makes the computer execute:

deciding whether the image read includes any one of the first guide information, the second guide information, and the third guide information; and when it is decide that the image read includes the first guide information, then forming on the paper the read image that includes the first guide information, when it is decide that the image read includes the second guide information, then forming the images read from the first surface and the second surface of the document on the paper, and when it is decide that the image read includes the third guide information, the forming the read image that includes the third guide information on the paper out of the images read from both sides of the document.

32. A computer program that makes the computer execute:

forming on a paper an image of a document with an image formation unit;

printing on the paper a guide information, which represents a layout of the document, with the image formation unit;

setting one of a single-side image formation mode of forming an image on a first surface of the paper, and a two-side image formation mode of forming images on the first surface and a second surface of the paper;

when the single-side image formation mode is set, then forming a first guide information that shows that a valid image is formed on the first surface of the paper a first guide information that shows that a valid image is formed on the first surface;

when the both-side image formation mode is set, then forming on any one of the first surface and the second surface of the paper a second guide information that shows that valid images are formed on the first surface and second surface of the paper;

when the single-side image formation mode is set, setting one of a normal single-side image formation mode of forming a valid image on the first surface of the paper having both the first surface and the second surface blank, and a back paper mode of forming a valid image on the second surface of the paper that has an invalid image formed on the first surface;

displaying the image read by the image reading unit and that does not include the guide information;

assigning whether the image displayed is necessary or not necessary; and forming on the paper a read image that is assigned as necessary.

33. A storage medium that stores the computer program that makes a computer execute:

forming on a paper an image of a document with an image formation unit; and printing on the paper a guide information, which represents a layout of the document, with the image formation unit, wherein the guide information comprises at least one mark having an orientation related to an orientation of the paper.

* * * * *